US012085320B2

(12) United States Patent
Takegami et al.

(10) Patent No.: US 12,085,320 B2
(45) Date of Patent: Sep. 10, 2024

(54) HEAT SOURCE UNIT AND REFRIGERATION APPARATUS

(71) Applicant: DAIKIN INDUSTRIES, LTD., Osaka (JP)

(72) Inventors: Masaaki Takegami, Osaka (JP); Akitoshi Ueno, Osaka (JP); Naoto Kimura, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/375,151

(22) Filed: Sep. 29, 2023

(65) Prior Publication Data

US 2024/0027116 A1 Jan. 25, 2024

Related U.S. Application Data

(63) Continuation of application No. PCT/JP2022/010817, filed on Mar. 11, 2022.

(30) Foreign Application Priority Data

Mar. 30, 2021 (JP) ..... 2021-057802
Nov. 25, 2021 (JP) ..... 2021-190691

(51) Int. Cl.
*F25B 49/02* (2006.01)
*F25B 1/04* (2006.01)
(Continued)

(52) U.S. Cl.
CPC ..... *F25B 49/02* (2013.01); *F25B 1/04* (2013.01); *F25B 40/02* (2013.01); *F25B 40/06* (2013.01); *F25B 2600/2513* (2013.01)

(58) Field of Classification Search
CPC .. F25B 49/02; F25B 1/04; F25B 40/02; F25B 40/06; F25B 2600/2513
See application file for complete search history.

(56) References Cited

U.S. PATENT DOCUMENTS

2007/0271936 A1* 11/2007 Wakamoto ..... F25B 7/00 62/160
2007/0271938 A1 11/2007 Wakamoto et al.
(Continued)

FOREIGN PATENT DOCUMENTS

JP 2008-164288 A 7/2008
JP 2008-261557 A 10/2008
(Continued)

OTHER PUBLICATIONS

International Search Report (PCT/ISA/210) issued in PCT/JP2022/010817, dated Apr. 19, 2022.
(Continued)

*Primary Examiner* — Henry T Crenshaw
(74) *Attorney, Agent, or Firm* — Birch, Stewart, Kolasch & Birch, LLP

(57) ABSTRACT

A heat source unit connected to a utilization unit includes a compressor, a first heat exchanger, a first expansion valve, and a receiver. The heat source unit further includes a first cooler and a second cooler. The first cooler cools a primary refrigerant flowing from the receiver toward the utilization unit. The second cooler cools the primary refrigerant flowing from the first heat exchanger functioning as a radiator toward the first expansion valve, using a coolant other than outdoor air.

22 Claims, 14 Drawing Sheets

(51) Int. Cl.
*F25B 40/02* (2006.01)
*F25B 40/06* (2006.01)

(56) References Cited

U.S. PATENT DOCUMENTS

| | | | | |
|---|---|---|---|---|
| 2011/0023514 | A1 | 2/2011 | Mitra et al. | |
| 2013/0025277 | A1* | 1/2013 | Enokijima | F01K 23/065 60/618 |
| 2022/0003483 | A1 | 1/2022 | Takegami et al. | |
| 2022/0146172 | A1 | 5/2022 | Taguchi et al. | |

FOREIGN PATENT DOCUMENTS

| | | | | |
|---|---|---|---|---|
| JP | WO 2010 061624 | | * | 6/2010 |
| JP | 2010-526985 | A | | 8/2010 |
| JP | 2015-152262 | A | | 8/2015 |
| JP | 2020-165585 | A | | 10/2020 |
| JP | 2021-32512 | A | | 3/2021 |
| WO | WO 2005/052467 | A1 | | 6/2005 |
| WO | WO 2010/061624 | A1 | | 6/2010 |

OTHER PUBLICATIONS

International Preliminary Report on Patentability and English translation of the Written Opinion of the International Searching Authority for International Application No. PCT/JP2022/010817, dated Oct. 12, 2023.

Extended European Search Report for corresponding European Application No. 22779960.8, dated Mar. 19, 2024.

* cited by examiner

HEAT SOURCE UNIT AND REFRIGERATION APPARATUS

CROSS REFERENCE TO RELATED APPLICATIONS

This application is a Continuation of PCT International Application No. PCT/JP2022/010817, filed on Mar. 11, 2022, which claims priority under 35 U.S.C. 119(a) to Patent Application No. 2021-057802, filed in Japan on Mar. 30, 2021, and Patent Application No. 2021-190691, filed in Japan on Nov. 25, 2021, all of which are hereby expressly incorporated by reference into the present application.

TECHNICAL FIELD

The present disclosure relates to a heat source unit and a refrigeration apparatus.

BACKGROUND ART

Patent Document 1 discloses a refrigeration apparatus using carbon dioxide as a refrigerant. This refrigeration apparatus performs a refrigeration cycle at, as a high pressure, a pressure higher than the critical pressure of the refrigerant. In this refrigeration apparatus, the refrigerant, which has dissipated heat in the outdoor heat exchanger, is decompressed and then flows into the receiver. The liquid refrigerant in the receiver is sent to a utilization unit, such as an indoor unit. The gas refrigerant in the receiver is sucked into the compressor.

CITATION LIST

Patent Document

Patent Document 1: Japanese Unexamined Patent Publication No. 2021-32512

SUMMARY

A first aspect of the present disclosure is directed to a heat source unit (10) connected to a utilization unit (50, 60) and configured to perform a refrigeration cycle of circulating a primary refrigerant between the heat source unit (10) and the utilization unit (50, 60) at, as a high pressure, a pressure higher than or equal to a critical pressure of the primary refrigerant. The heat source unit (10) includes: a compressor (22, 23) configured to suck and compress the primary refrigerant; a first heat exchanger (13) configured to exchange heat between the primary refrigerant and outdoor air; a first expansion valve (14) configured to decompress the primary refrigerant that has flowed out of the first heat exchanger (13) functioning as a radiator; a receiver (15) configured to receive the primary refrigerant that has flowed out of the first heat exchanger (13) functioning as a radiator and passed through the first expansion valve (14); a first cooler (16) configured to cool the primary refrigerant flowing from the receiver (15) toward the utilization unit (50, 60); and a second cooler (155) configured to cool the primary refrigerant flowing from the first heat exchanger (13) functioning as a radiator toward the first expansion valve (14), using a coolant other than the outdoor air.

DESCRIPTION OF EMBODIMENTS

Embodiments will be described with reference to the drawings. The following embodiments are merely exemplary ones in nature, and are not intended to limit the scope, application, or use of the present invention.

First Embodiment

A first embodiment will be described. A refrigeration apparatus (1) according to this embodiment can cool an object to be cooled, and can condition indoor air. The object to be cooled herein includes air in facilities such as a refrigerator, a freezer, and a show case.

—General Configuration of Refrigeration Apparatus—

Figure 1:
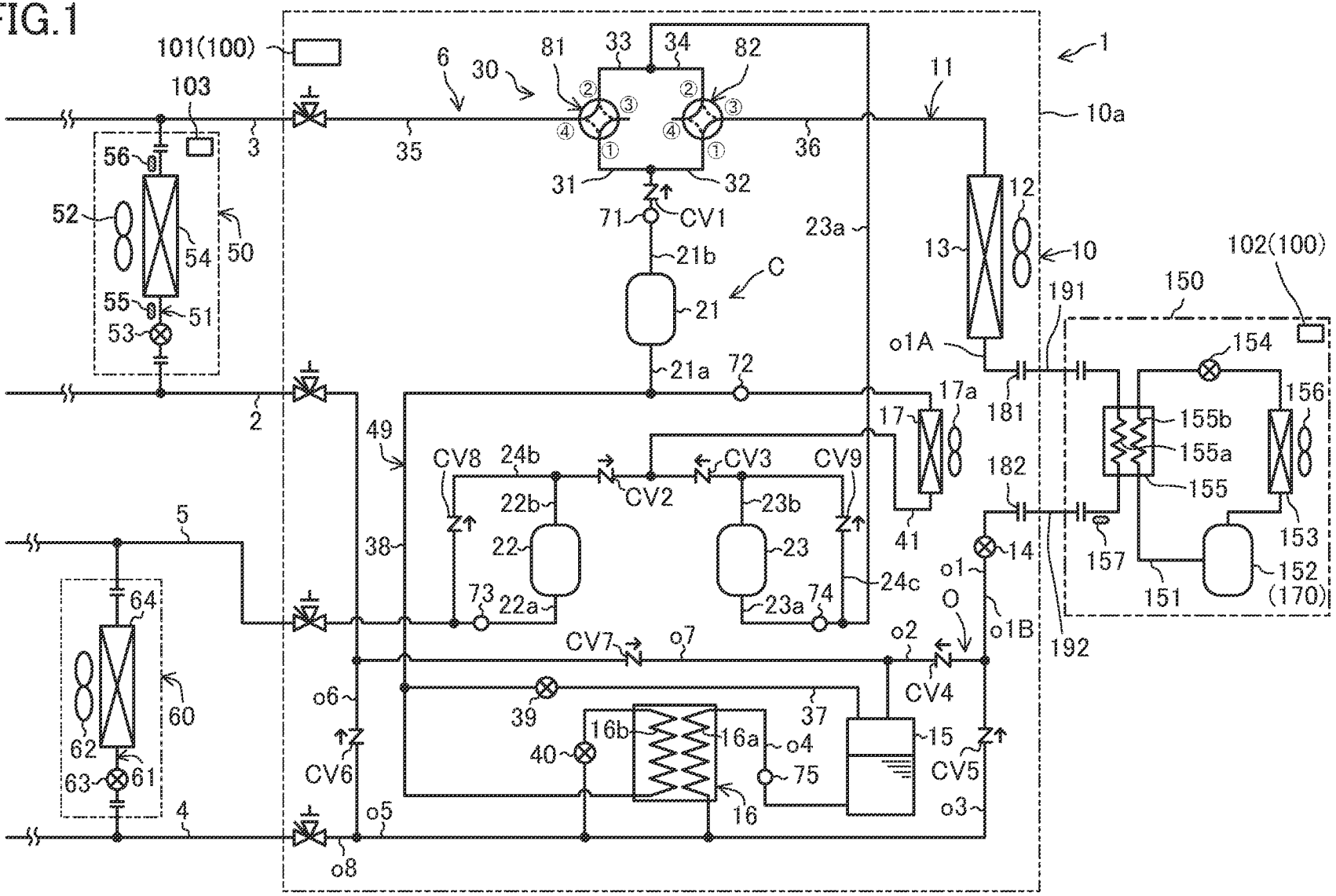
FIG. 1 is a piping system diagram showing a configuration of a refrigeration apparatus according to a first embodiment.

As illustrated in FIG. 1, the refrigeration apparatus (1) includes a heat source unit (10) placed outdoors, an air-conditioning unit (50) configured to perform air-conditioning of an indoor space, and a cooling unit (60) configured to cool inside air. The refrigeration apparatus (1) according to this embodiment includes one main unit (10*a*), a plurality of cooling units (60), and a plurality of air-conditioning units (50). The heat source unit (10) includes the main unit (10*a*) and an auxiliary unit (150). The refrigeration apparatus (1) may include one cooling unit (60) or one air-conditioning unit (50).

In the refrigeration apparatus (1), the main unit (10*a*) of the heat source unit (10), the cooling units (60), the air-conditioning units (50), and connection pipes (2, 3, 4, 5) connecting these units (10, 50, 60) together form a refrigerant circuit (6).

In the refrigerant circuit (6), a primary refrigerant circulates for a refrigeration cycle. The primary refrigerant in the refrigerant circuit (6) according to this embodiment is carbon dioxide. The refrigerant circuit (6) performs the refrigeration cycle at, as a high pressure, a pressure higher than or equal to the critical pressure of the primary refrigerant.

In the refrigerant circuit (6), the plurality of air-conditioning units (50) are connected through a first liquid connection pipe (2) and a first gas connection pipe (3) to the main unit (10*a*). In the refrigerant circuit (6), the plurality of air-conditioning units (50) are connected together in parallel.

In the refrigerant circuit (6), the plurality of cooling units (60) are connected through a second liquid connection pipe (4) and a second gas connection pipe (5) to the main unit (10*a*). In the refrigerant circuit (6), the plurality of cooling units (60) are connected together in parallel.

—Heat Source Unit—

As described above, the heat source unit (10) includes the main unit (10*a*) and the auxiliary unit (150). The main unit (10*a*) and the auxiliary unit (150) are connected by a first connection pipe (191) and a second connection pipe (192). The main unit (10*a*) and the auxiliary unit (150) are placed outdoors.

—Main Unit—

The main unit (10*a*) includes an outdoor fan (12) and an outdoor circuit (11). The outdoor circuit (11) includes a compression element (C), a channel switching mechanism (30), an outdoor heat exchanger (13), an outdoor expansion valve (14), a receiver (15), a subcooling heat exchanger (16), and an intercooler (17). The main unit (10*a*) includes an outdoor controller (101).

<Compression Element>

The compression element (C) compresses the primary refrigerant. The compression element (C) includes a high-stage compressor (21), a first low-stage compressor (23), and a second low-stage compressor (22). The high-stage compressor (21), the first low-stage compressor (23), and the second low-stage compressor (22) are each a rotary compressor in which a motor drives a compression mechanism. The high-stage compressor (21), the first low-stage compressor (23), and the second low-stage compressor (22) are of a variable capacity type capable of changing the rotational speed of the associated compression mechanism.

The compression element (C) performs two-stage compression. The first low-stage compressor (23) compresses the primary refrigerant sucked from each air-conditioning unit (50) or the outdoor heat exchanger (13). The second low-stage compressor (22) compresses the primary refrigerant sucked from each cooling unit (60). The high-stage compressor (21) sucks and compresses the primary refrigerants discharged from the first low-stage compressor (23) and the second low-stage compressor (22).

The high-stage compressor (21) is connected to a high-stage suction pipe (21*a*) and a high-stage discharge pipe (21*b*). The first low-stage compressor (23) is connected to a first low-stage suction pipe (23*a*) and a first low-stage discharge pipe (23*b*). The second low-stage compressor (22) is connected to a second low-stage suction pipe (22*a*) and a second low-stage discharge pipe (22*b*). In the compression element (C), the first low-stage discharge pipe (23*b*) and the second low-stage discharge pipe (22*b*) are connected to the high-stage suction pipe (21*a*).

The second low-stage suction pipe (22*a*) is connected to the second gas connection pipe (5). The second low-stage compressor (22) communicates with the cooling units (60) through the second gas connection pipe (5). The first low-stage suction pipe (23*a*) communicates with the air-conditioning units (50) through the channel switching mechanism (30) and the first gas connection pipe (3).

The compression element (C) includes a first low-stage pipe (24*c*) and a second low-stage pipe (24*b*). The first low-stage pipe (24*c*) allows the primary refrigerant to flow while bypassing the first low-stage compressor (23). The first low-stage pipe (24*c*) has two ends respectively connected to the first low-stage suction pipe (23*a*) and the first low-stage discharge pipe (23*b*). The first low-stage pipe (24*c*) is in parallel with the first low-stage compressor (23). The second low-stage pipe (24*b*) allows the primary refrigerant to flow while bypassing the second low-stage compressor (22). The second low-stage pipe (24*b*) has two ends respectively connected to the second low-stage suction pipe (22*a*) and the second low-stage discharge pipe (22*b*). The second low-stage pipe (24*b*) is in parallel with the second low-stage compressor (22).

<Channel Switching Mechanism>

The channel switching mechanism (30) selects one of channels of the primary refrigerant in the refrigerant circuit (6). The channel switching mechanism (30) includes a first pipe (31), a second pipe (32), a third pipe (33), a fourth pipe (34), a first switching valve (81), and a second switching valve (82).

The inflow end of the first pipe (31) and the inflow end of the second pipe (32) are connected to the high-stage discharge pipe (21*b*). The outflow end of the third pipe (33) and the outflow end of the fourth pipe (34) are connected to the first low-stage suction pipe (23*a*).

The first switching valve (81) and the second switching valve (82) each switch the channels of the primary refrigerant sucked into the first low-stage compressor (23) and the primary refrigerant discharged from the high-stage compressor (21). The first switching valve (81) and the second switching valve (82) are each a four-way switching valve.

The first port of the first switching valve (81) is connected to the outflow end of the first pipe (31). The second port of the first switching valve (81) is connected to the inflow end of the third pipe (33). The third port of the first switching valve (81) is closed. The fourth port of the first switching valve (81) is connected to one end of a first outdoor gas pipe (35). The other end of the first outdoor gas pipe (35) is connected to the first gas connection pipe (3).

The first port of the second switching valve (82) is connected to the outflow end of the second pipe (32). The second port of the second switching valve (82) is connected to the inflow end of the fourth pipe (34). The third port of the second switching valve (82) is connected to a second outdoor gas pipe (36). The fourth port of the second switching valve (82) is closed.

The first switching valve (81) and the second switching valve (82) each switch between a first state (the state indicated by the solid curves in FIG. 1) and a second state (the state indicated by the broken curves in FIG. 1). In each switching valve (81, 82) in the first state, the first port and the third port communicate with each other, and the second port and the fourth port communicate with each other. In each switching valve (81, 82) in the second state, the first port and the fourth port communicate with each other, and the second port and the third port communicate with each other.

<Outdoor Heat Exchanger, Outdoor Fan>

The outdoor heat exchanger (13) serves as a first heat exchanger. The outdoor heat exchanger (13) is a fin-and-tube air heat exchanger. The outdoor fan (12) is disposed near the outdoor heat exchanger (13). The outdoor fan (12) transfers outdoor air. The outdoor heat exchanger (13) exchanges heat between the primary refrigerant flowing therethrough and the outdoor air transferred by the outdoor fan (12).

The outdoor heat exchanger (13) has a gas end connected to the second outdoor gas pipe (36). The outdoor heat exchanger (13) has a liquid end connected to an outdoor channel (O).

<Outdoor Channel>

The outdoor channel (O) includes a first outdoor pipe (o1), a second outdoor pipe (o2), a third outdoor pipe (o3), a fourth outdoor pipe (o4), a fifth outdoor pipe (o5), a sixth outdoor pipe (o6), a seventh outdoor pipe (o7), and an eighth outdoor pipe (o8).

The first outdoor pipe (o1) includes a first part (o1A) and a second part (o1B). One end of the first part (o1A) is connected to the liquid end of the outdoor heat exchanger (13). The other end of the first part (o1A) is provided with a first connection port (181). One end of the second part (o1B) is provided with a second connection port (182). The other end of the second part (o1B) is connected to one end of the second outdoor pipe (o2) and one end of the third outdoor pipe (o3). The other end of the second outdoor pipe (o2) is connected to the top of the receiver (15).

One end of the fourth outdoor pipe (o4) is connected to the bottom of the receiver (15). The other end of the fourth outdoor pipe (o4) is connected to one end of the fifth outdoor pipe (o5) and the other end of the third outdoor pipe (o3). The other end of the fifth outdoor pipe (o5) is connected to one end of the sixth outdoor pipe (o6) and one end of the eighth outdoor pipe (o8).

The other end of the eighth outdoor pipe (o8) is connected to a first liquid-side trunk pipe (4*a*) of the second liquid connection pipe (4). The eighth outdoor pipe (o8) is a liquid pipe allowing the flow of a liquid refrigerant downstream of the receiver (15). The other end of the sixth outdoor pipe (o6) is connected to the first liquid connection pipe (2). One end of the seventh outdoor pipe (o7) is connected to an intermediate portion of the sixth outdoor pipe (o6). The other end of the seventh outdoor pipe (o7) is connected to an intermediate portion of the second outdoor pipe (o2).

<Outdoor Expansion Valve>

The first outdoor pipe (o1) of the outdoor circuit (11) is provided with the outdoor expansion valve (14). The first outdoor pipe (o1) according to this embodiment is provided with the outdoor expansion valve (14) at the second part (o1B). The outdoor expansion valve (14) is an electronic expansion valve having a variable opening degree. The outdoor expansion valve (14) serves as a first expansion valve.

<Receiver>

The receiver (15) serves as a container that stores the primary refrigerant. The receiver (15) is placed downstream of the outdoor expansion valve (14). In the receiver (15), a gas refrigerant and a liquid refrigerant coexist. The top of the receiver (15) is connected to the other end of the second outdoor pipe (o2) and one end of a venting pipe (37) which will be described later.

<Intermediate Injection Circuit>

The outdoor circuit (11) includes an intermediate injection circuit (49). The intermediate injection circuit (49) supplies the primary refrigerant decompressed by the outdoor expansion valve (14) to the high-stage suction pipe (21*a*). The intermediate injection circuit (49) includes the venting pipe (37) and an injection pipe (38).

One end of the injection pipe (38) is connected to an intermediate portion of the fifth outdoor pipe (o5). The other end of the injection pipe (38) is connected to the high-stage suction pipe (21*a*). The injection pipe (38) is provided with an injection valve (40). The injection valve (40) is an expansion valve having a variable opening degree.

The venting pipe (37) is a gas pipe for sending the gas refrigerant of the receiver (15) to the high-stage suction pipe (21*a*). Specifically, one end of the venting pipe (37) is connected to the top of the receiver (15). The other end of the venting pipe (37) is connected to an intermediate portion of the injection pipe (38). The venting pipe (37) is connected to a venting valve (39). The venting valve (39) is an electronic expansion valve having a variable opening degree. The venting valve (39) is a decompression section that decompresses the refrigerant flowing through the venting pipe (37).

<Subcooling Heat Exchanger>

The outdoor circuit (11) includes the subcooling heat exchanger (16). The subcooling heat exchanger (16) serves as a first cooler that cools the primary refrigerant (mainly the liquid refrigerant) that has flowed out of the receiver (15). The subcooling heat exchanger (16) is placed downstream of the receiver (15). The subcooling heat exchanger (16) has a first channel (16*a*) and a second channel (16*b*). The subcooling heat exchanger (16) exchanges heat between the primary refrigerant flowing through the first channel (16*a*) and the refrigerant flowing through the second channel (16*b*).

The first channel (16*a*) is connected to an intermediate portion of the fourth outdoor pipe (o4). The second channel (16*b*) is included in the intermediate injection circuit (49). Specifically, the second channel (16*b*) is connected to a point of the injection pipe (38) downstream of the injection valve (40). Flowing through the second channel (16*b*) is the primary refrigerant that has been decompressed at the injection valve (40). In the subcooling heat exchanger (16), the primary refrigerant flowing through the first channel (16*a*) is cooled by the primary refrigerant flowing through the second channel (16*b*).

<Intercooler>

The intercooler (17) is connected to an intermediate channel (41). One end of the intermediate channel (41) is connected to the first low-stage discharge pipe (23*b*) and the second low-stage discharge pipe (22*b*). The other end of the intermediate channel (41) is connected to the high-stage suction pipe (21*a*).

The intercooler (17) is a fin-and-tube air heat exchanger. Placed near the intercooler (17) is a fan (17*a*). The intercooler (17) exchanges heat between the primary refrigerant flowing therethrough and the outdoor air transferred by the fan (17*a*).

<Check Valve>

The outdoor circuit (11) has a first check valve (CV1), a second check valve (CV2), a third check valve (CV3), a fourth check valve (CV4), a fifth check valve (CV5), a sixth check valve (CV6), a seventh check valve (CV7), an eighth check valve (CV8), and a ninth check valve (CV9). Each of these check valves (CV1 to CV9) allows the primary refrigerant to flow in the direction of the associated arrow shown in FIG. 1 and prohibits the primary refrigerant to flow in the opposite direction.

The first check valve (CV1) is connected to the high-stage discharge pipe (21*b*). The second check valve (CV2) is connected to the second low-stage discharge pipe (22*b*). The third check valve (CV3) is connected to the first low-stage discharge pipe (23*b*). The fourth check valve (CV4) is connected to the second outdoor pipe (o2). The fifth check valve (CV5) is connected to the third outdoor pipe (o3). The sixth check valve (CV6) is connected to the sixth outdoor pipe (o6). The seventh check valve (CV7) is connected to the seventh outdoor pipe (o7). The eighth check valve (CV8) is connected to the second low-stage pipe (24*b*). The ninth check valve (CV9) is connected to the first low-stage pipe (24*c*).

<Sensor>

The main unit (10*a*) includes various sensors. The sensors include a high-pressure sensor (71), an intermediate-pressure sensor (72), a first low-pressure sensor (74), a second low-pressure sensor (73), and a liquid refrigerant pressure sensor (75). The values measured by the sensors in the main unit (10*a*) are transmitted to the outdoor controller (101).

The high-pressure sensor (71) detects the pressure of the primary refrigerant (a pressure HP of a high-pressure refrigerant) discharged from the high-stage compressor (21). The intermediate-pressure sensor (72) detects the pressure of the primary refrigerant in the intermediate channel (41), in other words, the pressure of the primary refrigerant between the high-stage compressor (21) and the pair of the second low-stage compressor (22) and the first low-stage compressor (23) (a pressure (MP) of an intermediate-pressure refrigerant). The second low-pressure sensor (73) detects the pressure of the primary refrigerant sucked into the second low-stage compressor (22). The first low-pressure sensor (74) detects the pressure of the primary refrigerant sucked into the first low-stage compressor (23). The liquid refrigerant pressure sensor (75) detects the pressure of the primary refrigerant (liquid refrigerant) that has flowed out of the receiver (15).

<Outdoor Controller>

Figure 2:
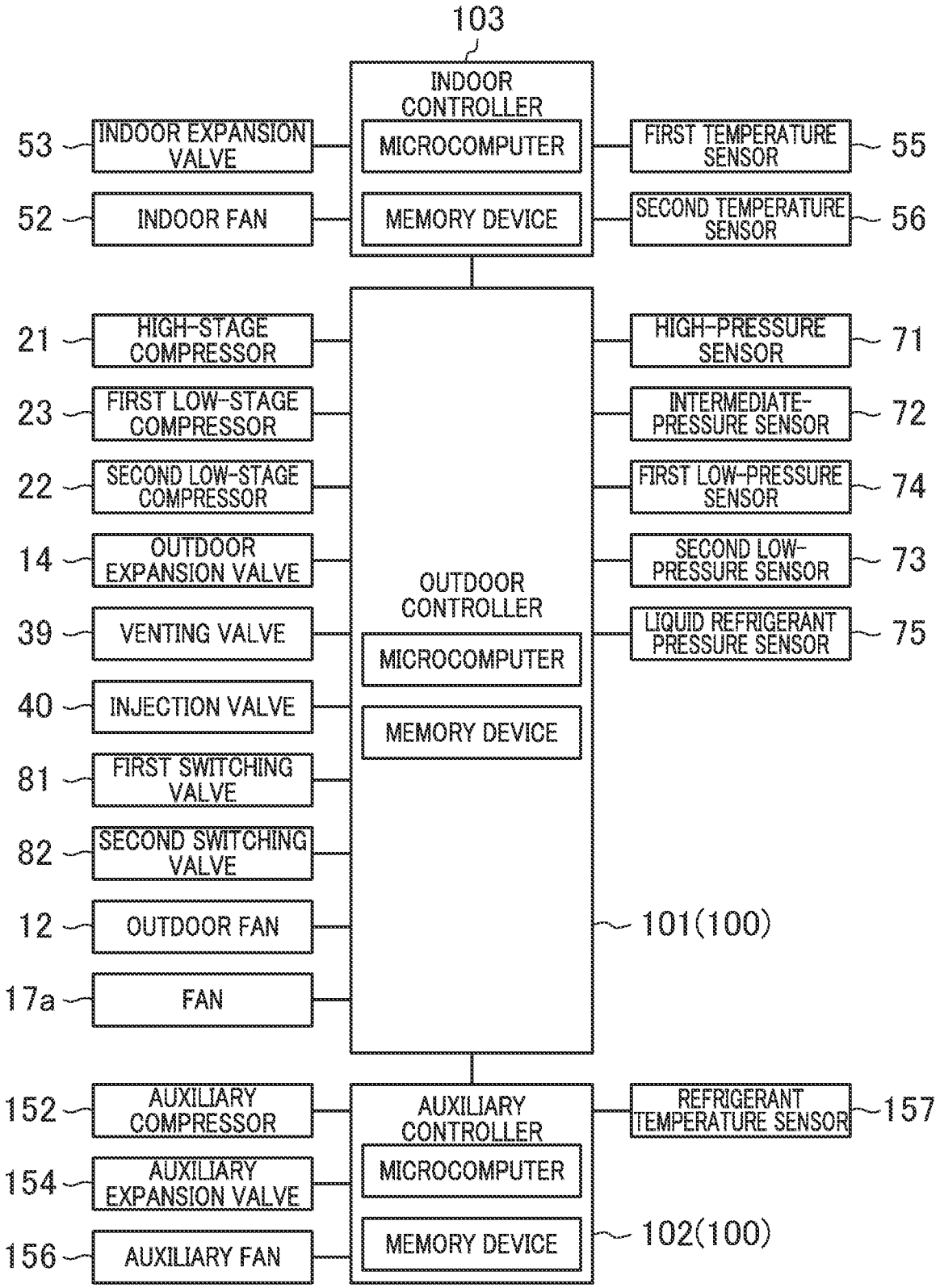
FIG. 2 is a block diagram showing a relationship among components, sensors, and a controller in the refrigeration apparatus according to the first embodiment.

As illustrated in FIG. 2, the outdoor controller (101) includes a microcomputer mounted on a control board, and a memory device storing software for operating the microcomputer. The memory device is a semiconductor memory. The outdoor controller (101) controls the components of the main unit (10*a*).

—Auxiliary Unit—

The auxiliary unit (150) includes an auxiliary refrigerant circuit (151), an auxiliary fan (156), a refrigerant temperature sensor (157), and an auxiliary controller (102). The auxiliary unit (150) is connected through the first connection pipe (191) to the first connection port (181) of the main unit (10*a*), and through the second connection pipe (192) to the second connection port (182) of the main unit (10*a*).

The auxiliary refrigerant circuit (151) includes an auxiliary compressor (152), an auxiliary outdoor heat exchanger (153), an auxiliary expansion valve (154), and a refrigerant cooler (155). In the auxiliary refrigerant circuit (151), the auxiliary outdoor heat exchanger (153), the auxiliary expansion valve (154), and the refrigerant cooler (155) are arranged in this order from a discharge pipe to a suction pipe of the auxiliary compressor (152). The auxiliary refrigerant circuit (151) is filled with carbon dioxide as a secondary refrigerant. The auxiliary refrigerant circuit (151) allows the secondary refrigerant to circulate therethrough to perform a refrigeration cycle.

<Auxiliary Compressor>

The auxiliary compressor (152) is a rotary compressor in which a motor drives a compression mechanism. The auxiliary compressor (152) is of a variable capacity type capable of changing the rotational speed of the compression mechanism. The auxiliary compressor (152) sucks and compresses the secondary refrigerant and discharges the compressed secondary refrigerant. The auxiliary compressor (152) serves as a switching section (170) that switches the refrigerant cooler (155) between the cooling mode and the inactive mode.

<Auxiliary Outdoor Heat Exchanger, Auxiliary Fan>

The auxiliary outdoor heat exchanger (153) is a fin-and-tube air heat exchanger. The auxiliary fan (156) is disposed near the auxiliary outdoor heat exchanger (153). The auxiliary fan (156) transfers outdoor air. The auxiliary outdoor heat exchanger (153) exchanges heat between the secondary refrigerant flowing therethrough and outdoor air transferred by the auxiliary fan (156).

<Auxiliary Expansion Valve>

The auxiliary expansion valve (154) is an electronic expansion valve having a variable opening degree. The auxiliary expansion valve (154) decompresses the secondary refrigerant flowing from the auxiliary outdoor heat exchanger (153) toward the refrigerant cooler (155).

<Refrigerant Cooler>

The refrigerant cooler (155) is a heat exchanger including a first channel (155*a*) and a second channel (155*b*).

One end of the first channel (155*a*) is connected through a pipe to the first connection pipe (191). The other end of the first channel (155*a*) is connected through a pipe to the second connection pipe (192). Flowing through the first channel (155*a*) is the primary refrigerant that has filled the outdoor circuit (11) of the main unit (10*a*).

The second channel (155*b*) is connected to the auxiliary refrigerant circuit (151). One end of the second channel (155*b*) is connected to the auxiliary expansion valve (154). The other end of the second channel (155*b*) is connected to a suction pipe of the auxiliary compressor (152). The secondary refrigerant that has filled the auxiliary refrigerant circuit (151) flows through the second channel (155*b*).

The refrigerant cooler (155) exchanges heat between the primary refrigerant flowing through the first channel (155*a*) and the secondary refrigerant flowing through the second channel (155*b*). The refrigerant cooler (155) serves as a second cooler. The refrigerant cooler (155) cools the primary refrigerant flowing from the outdoor heat exchanger (13) toward the outdoor expansion valve (14), using the secondary refrigerant as a coolant. The refrigerant cooler (155) is switched between the cooling mode of cooling the primary refrigerant and the inactive mode of cooling no primary refrigerant.

<Refrigerant Temperature Sensor>

The refrigerant temperature sensor (157) is attached to a pipe connecting the first channel (155*a*) of the refrigerant cooler (155) and the second connection pipe (192). The refrigerant temperature sensor (157) measures the temperature of the primary refrigerant flowing through this pipe. The value measured by the refrigerant temperature sensor (157) is transmitted to the auxiliary controller (102).

<Auxiliary Controller>

As illustrated in FIG. 2, the auxiliary controller (102) includes a microcomputer mounted on a control board, and a memory device storing software for operating the microcomputer. The memory device is a semiconductor memory. The auxiliary controller (102) controls the auxiliary compressor (152), the auxiliary expansion valve (154), and the auxiliary fan (156).

The auxiliary controller (102) is connected through a signal line to the outdoor controller (101) of the main unit (10*a*). The auxiliary controller (102) is communicative with the outdoor controller (101) and exchanges signals with the outdoor controller (101). The auxiliary controller (102) and the outdoor controller (101) form a controller (100) of the heat source unit (10).

—Air-Conditioning Unit—

The air-conditioning units (50) are utilization units placed indoors. The air-conditioning units (50) each condition air in an indoor space. The air-conditioning units (50) each include an indoor fan (52), an indoor circuit (51), and an indoor controller (103). The indoor circuit (51) has a liquid end connected to the first liquid connection pipe (2). The indoor circuit (51) has a gas end connected to the first gas connection pipe (3).

<Indoor Circuit, Indoor Fan>

The indoor circuit (51) includes an indoor expansion valve (53) and an indoor heat exchanger (54) in this order from the liquid end to the gas end.

The indoor expansion valve (53) is an electronic expansion valve having a variable opening degree. The indoor expansion valve (53) serves as a second expansion valve. The indoor heat exchanger (54) is a fin-and-tube air heat exchanger. The indoor heat exchanger (54) serves as a second heat exchanger. The indoor fan (52) is disposed near the indoor heat exchanger (54). The indoor fan (52) transfers indoor air. The indoor heat exchanger (54) exchanges heat between the primary refrigerant flowing therethrough and indoor air transferred from the indoor fan (52).

<Temperature Sensor>

The indoor circuit (51) includes a first temperature sensor (55) and a second temperature sensor (56). The first temperature sensor (55) is placed at a portion of the indoor circuit (51) between the liquid end of the indoor heat exchanger (54) and the indoor expansion valve (53), and measures the temperature of the primary refrigerant flowing through the portion. The second temperature sensor (56) is placed at a portion of the indoor circuit (51) closer to the gas end of the indoor heat exchanger (54), and measures the temperature of the primary refrigerant flowing through the portion. The values measured by the first temperature sensor (55) and the second temperature sensor (56) are transmitted to the indoor controller (103).

<Indoor Controller>

As illustrated in FIG. 2, each indoor controller (103) includes a microcomputer mounted on a control board, and a memory device storing software for operating the microcomputer. The memory device is a semiconductor memory. The indoor controller (103) controls the indoor expansion valve (53) and the indoor fan (52).

The indoor controller (103) adjusts the opening degree of the indoor expansion valve (53) based on the values measured by the first temperature sensor (55) and the second temperature sensor (56). The indoor controller (103) is a superheat controller that adjusts the degree of superheat of the primary refrigerant that has flowed out of the associated indoor heat exchanger (54) functioning as an evaporator.

The indoor controller (103) is connected through a signal line to the outdoor controller (101) of the main unit (10*a*). The indoor controller (103) is communicative with the outdoor controller (101) and exchanges signals with the outdoor controller (101).

<Cooling Unit>

The cooling units (60) are utilization units placed indoors. The cooling units (60) are each, for example, a refrigerated show case installed in a store, such as a convenience store. Each cooling unit (60) may be a unit cooler that cools the inside air in a refrigerator.

Each cooling unit (60) includes a cooling fan (62) and a cooling circuit (61). The cooling circuit (61) has a liquid end connected to a liquid-side branch pipe of the second liquid connection pipe (4). The cooling circuit (61) has a gas end connected to a gas-side branch pipe of a second gas connection pipe (5).

The cooling circuit (61) includes a cooling expansion valve (63) and a cooling heat exchanger (64) in this order from the liquid end to the gas end. The cooling expansion valve (63) is an electronic expansion valve having a variable opening degree. The cooling heat exchanger (64) is a fin-and-tube air heat exchanger. The cooling fan (62) is disposed near the cooling heat exchanger (64). The cooling fan (62) transfers inside air. The cooling heat exchanger (64) exchanges heat between the primary refrigerant flowing therethrough and inside air transferred by the cooling fan (62).

—Operation of Refrigeration Apparatus—

An operation of the refrigeration apparatus (1) will be described. The refrigeration apparatus (1) performs a cooling operation and a heating operation.

<Cooling Operation>

The cooling operation of the refrigeration apparatus (1) will be described. In the cooling operation, the air-conditioning units (50) cool indoor spaces.

In the cooling operation, the first switching valve (81) and the second switching valve (82) are set to the first state. In the cooling operation, the first low-stage compressor (23), the second low-stage compressor (22), and the high-stage compressor (21) operate. In the cooling operation, the refrigerant circuit (6) allows the primary refrigerant to circulate therethrough to perform a refrigeration cycle. The outdoor heat exchanger (13) functions as a radiator (a gas cooler), and the cooling heat exchangers (64) and the indoor heat exchangers (54) function as evaporators.

In the cooling operation, the auxiliary compressor (152) of the auxiliary unit (150) operates as necessary. Once the auxiliary compressor (152) starts operating, the auxiliary refrigerant circuit (151) allows the secondary refrigerant to circulate therethrough to perform a refrigeration cycle. The auxiliary outdoor heat exchanger (153) functions as a radiator (a gas cooler), and the refrigerant cooler (155) functions as an evaporator.

Figure 3:
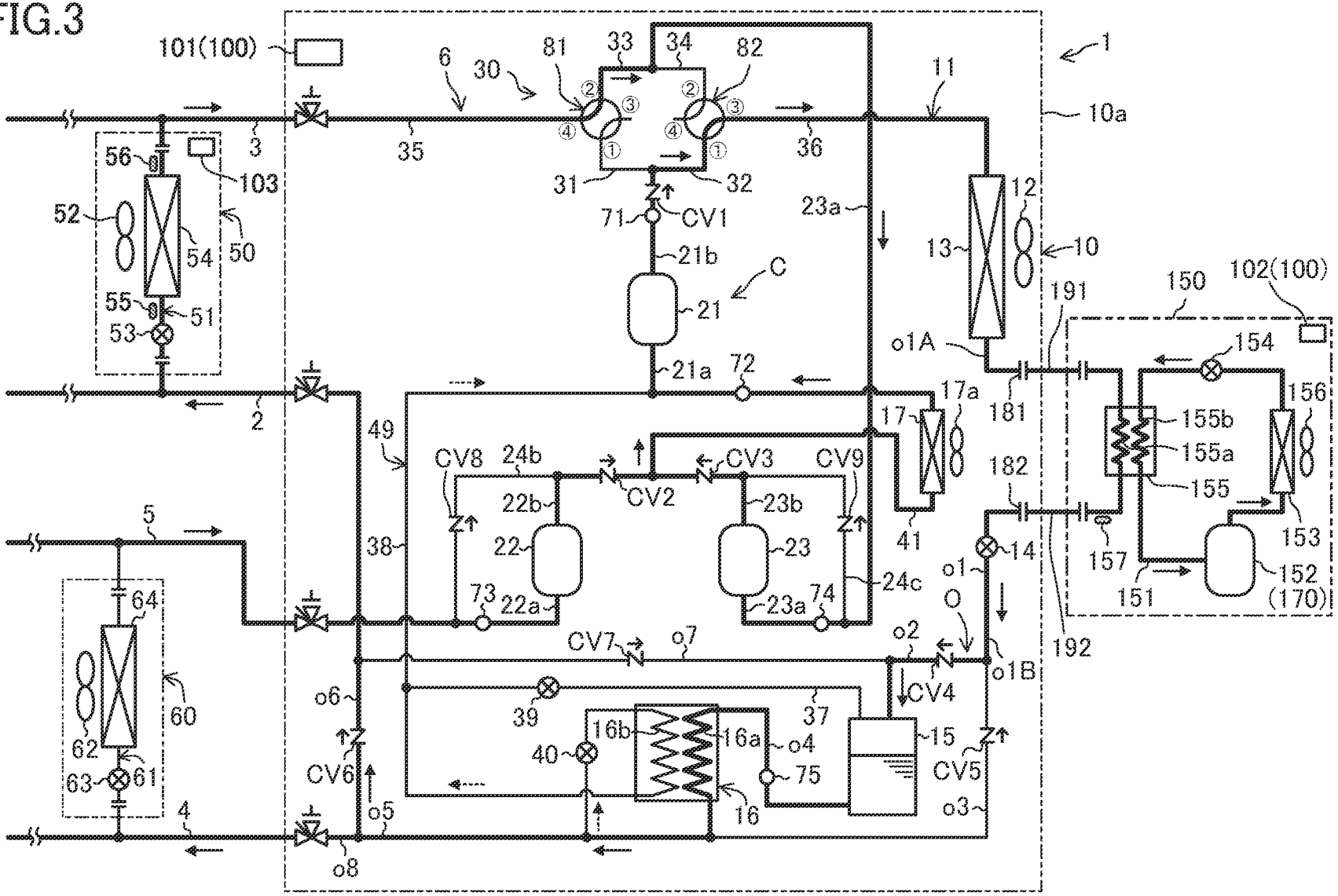
FIG. 3 corresponds to FIG. 1 and illustrates a flow of a refrigerant in a cooling operation.
Figure 4:
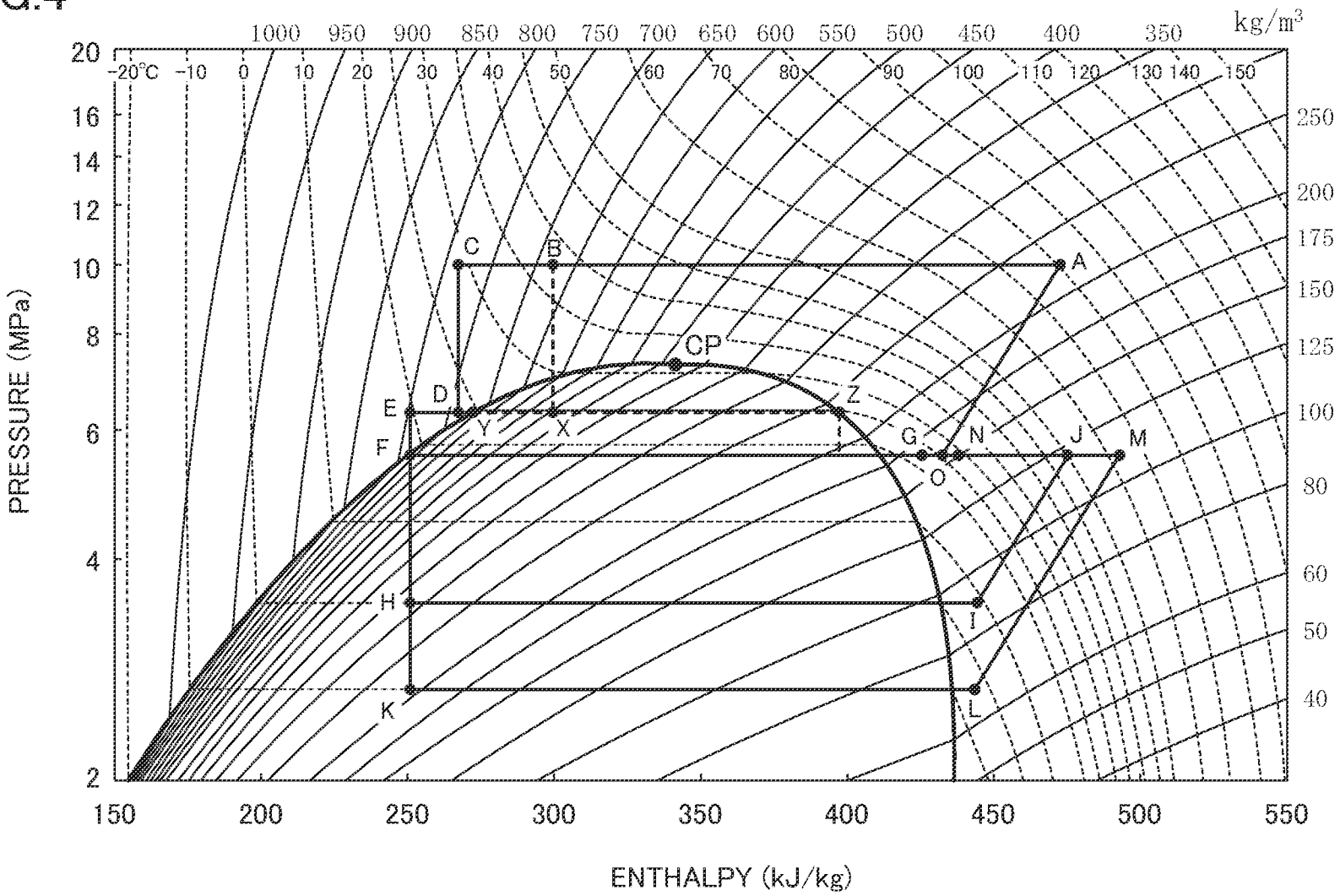
FIG. 4 is a Mollier diagram (pressure-enthalpy diagram) showing a refrigeration cycle in a refrigerant circuit in the cooling operation according to the first embodiment.

Here, the cooling operation of the refrigeration apparatus (1) will be described with reference to FIGS. 3 and 4, using an example where the auxiliary compressor (152) operates. The Mollier diagram in FIG. 4 shows the refrigeration cycle performed in the refrigerant circuit (6) when the venting valve (39) is closed.

The high-stage compressor (21) compresses the sucked primary refrigerant to a pressure higher than the critical pressure of the primary refrigerant and discharges the compressed primary refrigerant. The primary refrigerant discharged from the high-stage compressor (21) (in the state at the point A in FIG. 4) flows through the second switching valve (82) into the outdoor heat exchanger (13) and dissipates heat to the outdoor air. The primary refrigerant that has flowed out of the outdoor heat exchanger (13) (in the state at the point B in FIG. 4) flows into the first channel (155*a*) of the refrigerant cooler (155) and is cooled by the secondary refrigerant flowing through the second channel (155*b*).

The primary refrigerant that has flowed out of the refrigerant cooler (155) (in the state at the point C in FIG. 4) is decompressed to a pressure lower than the critical pressure of the primary refrigerant, when passing through the outdoor expansion valve (14). The primary refrigerant that has passed through the outdoor expansion valve (14) (in the state at the point D in FIG. 4) flows into the receiver (15). In FIG. 4, the primary refrigerant flowing into the receiver (15) is in a liquid single-phase state.

In the heat source unit (10) according to this embodiment, while the auxiliary compressor (152) is operating, the primary refrigerant flowing into the receiver (15) is kept in the liquid single-phase state. On the other hand, while the auxiliary compressor (152) is stopped, the primary refrigerant flowing into the receiver (15) may be in a liquid single-phase state or a gas-liquid two-phase state depending on the operating conditions, such as the outdoor air temperature or the flow rate of the primary refrigerant.

The primary refrigerant that has flowed out of the receiver (15) flows into the first channel (16*a*) of the subcooling heat exchanger (16) and is cooled by the primary refrigerant flowing through the second channel (16*b*). Part of the primary refrigerant that has flowed out of the first channel (16*a*) of the subcooling heat exchanger (16) (in the state at the point E in FIG. 4) flows into the injection pipe (38), while the rest flows separately into the sixth outdoor pipe (o6) and the eighth outdoor pipe (o8).

The primary refrigerant that has flowed into the injection pipe (38) is decompressed when passing through the injection valve (40). The primary refrigerant that has passed through the injection valve (40) (in the state at the point F in FIG. 4) flows into the second channel (16*b*) of the subcooling heat exchanger (16), absorbs heat from the primary refrigerant flowing through the first channel (16*a*), and evaporates. The primary refrigerant that has flowed out of the second channel (16*b*) of the subcooling heat exchanger (16) (in the state at the point G in FIG. 4) flows into the high-stage suction pipe (21*a*).

The primary refrigerant flowing into the sixth outdoor pipe (o6) flows into the first liquid connection pipe (2) and is distributed among the plurality of air-conditioning units (50). In each air-conditioning unit (50), the primary refrigerant that has flowed into the indoor circuit (51) is decompressed when passing through the indoor expansion valve (53). In each air-conditioning unit (50), the primary refrigerant that has passed through the indoor expansion valve (53) (in the state at the point H in FIG. 4) flows into the indoor heat exchanger (54), absorbs heat from the indoor air, and evaporates. Each air-conditioning unit (50) blows the air cooled in the indoor heat exchanger (54) into the indoor space.

The primary refrigerant that has flowed out of the indoor heat exchanger (54) of each air-conditioning unit (50) (in the state at the point I in FIG. 4) flows and merges into the first gas connection pipe (3), flows into the first outdoor gas pipe (35) of the outdoor circuit (11), flows through the first switching valve (81) into the first low-stage suction pipe (23*a*), and is then sucked into the first low-stage compressor (23). The first low-stage compressor (23) compresses the sucked primary refrigerant and discharges the compressed primary refrigerant. The primary refrigerant discharged from the first low-stage compressor (23) (in the state at the point J in FIG. 4) flows through the first low-stage discharge pipe (23*b*) into the intermediate channel (41).

The primary refrigerant flowing through the eighth outdoor pipe (o8) flows into the second liquid connection pipe (4) and is distributed to the plurality of cooling units (60). In each cooling unit (60), the primary refrigerant that has flowed into the cooling circuit (61) is decompressed when passing through the cooling expansion valve (63). In each cooling unit (60), the primary refrigerant that has passed through the cooling expansion valve (63) (in the state at the point K in FIG. 4) flows into the cooling heat exchanger (64), absorbs heat from the inside air, and evaporates. Each cooling unit (60) blows the air cooled in the cooling heat exchanger (64) into the inside space.

The primary refrigerant that has flowed out of the cooling heat exchanger (64) of each cooling unit (60) (in the state at the point L in FIG. 4) flows and merges into the second gas connection pipe (5), flows into the second low-stage suction pipe (22*a*) of the outdoor circuit (11), and is then sucked into the second low-stage compressor (22). The second low-stage compressor (22) compresses the primary refrigerant sucked thereinto and discharges the compressed primary refrigerant. The primary refrigerant discharged from the second low-stage compressor (22) (in the state at the point M in FIG. 4) flows through the second low-stage discharge pipe (22*b*) into the intermediate channel (41).

The primary refrigerant flowing through the intermediate channel (41) dissipates heat to the outdoor air in the intercooler (17). The primary refrigerant, which has flowed out of the intercooler (17) (in the state at the point N in FIG. 4), merges into the primary refrigerant flowing in from the injection pipe (38) and flows into the high-stage suction pipe (21*a*). The primary refrigerant flowing through the high-stage suction pipe (21*a*) (in the state at the point O in FIG. 4) is sucked into the high-stage compressor (21). The high-stage compressor (21) compresses and discharges the sucked primary refrigerant.

In the auxiliary refrigerant circuit (151), the secondary refrigerant discharged from the auxiliary compressor (152) dissipates heat to outdoor air in the auxiliary outdoor heat exchanger (153). The secondary refrigerant that has flowed out of the auxiliary outdoor heat exchanger (153) is decompressed when passing through the auxiliary expansion valve (154) and then flows into the second channel (155*b*) of the refrigerant cooler (155). In the second channel (155*b*) of the refrigerant cooler (155), the secondary refrigerant absorbs heat from the primary refrigerant in the first channel (155*a*) and evaporates. The secondary refrigerant that has flowed out of the refrigerant cooler (155) is sucked into and compressed by the auxiliary compressor (152).

<Heating Operation>

The heating operation of the refrigeration apparatus (1) will be described. In the heating operation, the air-conditioning units (50) heat indoor spaces.

In the heating operation, the refrigeration apparatus (1) selectively performs an operation in which the outdoor heat exchanger (13) functions as a radiator, an operation in which the outdoor heat exchanger (13) is inactive, and an operation in which the outdoor heat exchanger (13) functions as an evaporator. In the refrigeration apparatus (1) performing the heating operation, the auxiliary unit (150) is kept stopped. Accordingly, in the heating operation, the auxiliary compressor (152) is kept stopped.

Figure 5:
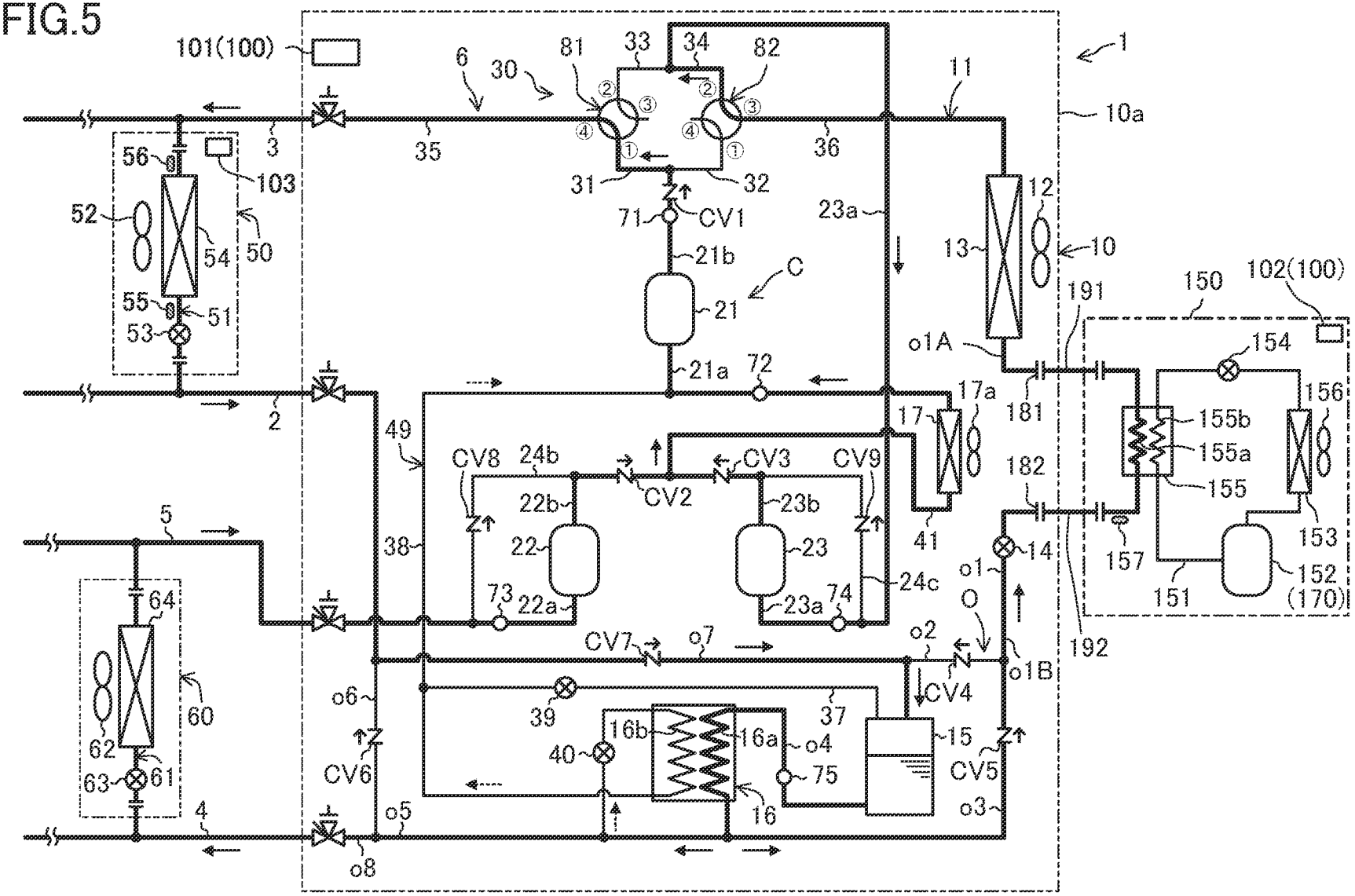
FIG. 5 corresponds to FIG. 1 and illustrates a flow of a refrigerant in a heating operation.

Here, the heating operation when the outdoor heat exchanger (13) functions as an evaporator will be described with reference to FIG. 5. In this heating operation, the first switching valve (81) and the second switching valve (82) are set to the second state. In this heating operation, the first low-stage compressor (23), the second low-stage compressor (22), and the high-stage compressor (21) operate. In this heating operation, the refrigerant circuit (6) allows the primary refrigerant to circulate therethrough to perform a refrigeration cycle. The indoor heat exchangers (54) function as radiators (gas coolers), and the cooling heat exchangers (64) and the outdoor heat exchanger (13) function as evaporators.

The primary refrigerant discharged from the high-stage compressor (21) flows through the first switching valve (81)

into the first outdoor gas pipe (35), then passes through the first gas connection pipe (3), and is distributed to the plurality of air-conditioning units (50). In each air-conditioning unit (50), the primary refrigerant that has flowed into the indoor circuit (51) dissipates heat to the indoor air in the indoor heat exchanger (54), is then decompressed when passing through the indoor expansion valve (53), and flows into the first liquid connection pipe (2). The primary refrigerant that has flowed from each air-conditioning unit (50) into the first liquid connection pipe (2) flows into the receiver (15) of the outdoor circuit (11). Each air-conditioning unit (50) blows the air heated in the indoor heat exchanger (54) into the indoor space.

The primary refrigerant that has flowed out of the receiver (15) is cooled while passing through the first channel (16*a*) of the subcooling heat exchanger (16). The primary refrigerant that has passed through the first channel (16*a*) of the subcooling heat exchanger (16) branches off and flows into the fifth outdoor pipe (o5) and the third outdoor pipe (o3).

Part of the primary refrigerant flowing through the fifth outdoor pipe (o5) flows into the injection pipe (38), while the rest flows into the eighth outdoor pipe (o8). The primary refrigerant flowing through the injection pipe (38) flows into the second channel (16*b*) of the subcooling heat exchanger (16), absorbs heat and evaporates, and then flows into the high-stage suction pipe (21*a*).

The primary refrigerant flowing through the eighth outdoor pipe (o8) passes through the second liquid connection pipe (4) and is distributed to the plurality of cooling units (60). In each cooling unit (60), the primary refrigerant that has flowed into the cooling circuit (61) is decompressed when passing through the cooling expansion valve (63), and then absorbs heat from the inside air in the cooling heat exchanger (64) and evaporates. Each cooling unit (60) blows the air cooled in the cooling heat exchanger (64) into the inside space.

The primary refrigerant that has flowed out of the cooling heat exchanger (64) of each cooling unit (60) flows and merges into the second gas connection pipe (5), flows into the second low-stage suction pipe (22*a*) of the outdoor circuit (11), and is then sucked into and compressed by the second low-stage compressor (22).

The primary refrigerant flowing through the third outdoor pipe (o3) is decompressed when passing through the outdoor expansion valve (14), then passes through the first channel (155*a*) of the refrigerant cooler (155), flows into the outdoor heat exchanger (13), absorbs heat from outdoor air, and evaporates. The primary refrigerant that has passed through the outdoor heat exchanger (13) flows through the second switching valve (82) into the first low-stage suction pipe (23*a*), and is then sucked into and compressed by the first low-stage compressor (23).

The primary refrigerant compressed in each of the first low-stage compressor (23) and the second low-stage compressor (22) dissipates heat to outdoor air in the intercooler (17), merges with the primary refrigerant flowing through the injection pipe (38), and is then sucked into the high-stage compressor (21). The high-stage compressor (21) compresses and discharges the sucked primary refrigerant.

—Operation of Controller—

As described above, the outdoor controller (101) of the main unit (10*a*) and the auxiliary controller (102) of the auxiliary unit (150) are connected to each other through the signal line to form the controller (100) of the heat source unit (10). Here, an operation of the controller (100) of the heat source unit (10) will be described.

<Control of Auxiliary Compressor>

When the refrigeration apparatus (1) starts the cooling operation, the outdoor controller (101) transmits, to the auxiliary controller (102), an enabling signal for enabling the operation of the auxiliary unit (150). On the other hand, when the refrigeration apparatus (1) ends the cooling operation, the outdoor controller (101) transmits, to the auxiliary controller (102), a disabling signal for disabling the operation of the auxiliary unit (150). In the heating operation of the refrigeration apparatus (1), the auxiliary unit (150) is thus kept stopped.

Figure 6:
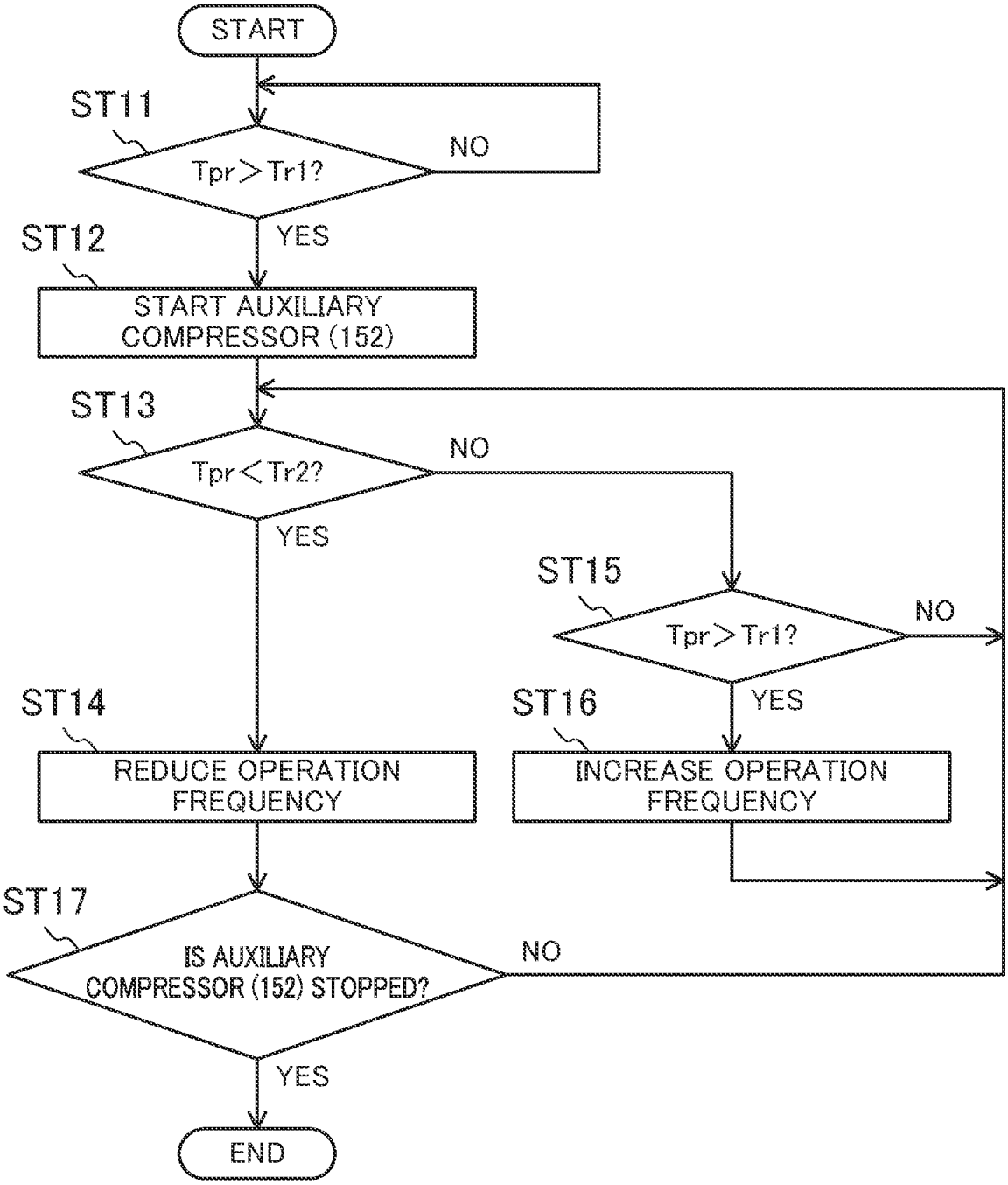
FIG. 6 is a flowchart showing an operation of an auxiliary controller in the refrigeration apparatus according to the first embodiment.

Upon receipt of the enabling signal, the auxiliary controller (102) starts controlling the auxiliary compressor (152). The auxiliary controller (102) controls the auxiliary compressor (152) based on a value Tpr measured by the refrigerant temperature sensor (157). An operation of the auxiliary controller (102) controlling the auxiliary compressor (152) will be described with reference to the flowchart in FIG. 6.

In the processing in a step ST11, the auxiliary controller (102) determines whether the condition that the value Tpr measured by the refrigerant temperature sensor (157) is higher than a first reference temperature Tr1 (Tpr>Tr1) is satisfied. If this condition is satisfied, the auxiliary controller (102) performs the processing in a step ST12. On the other hand, if this condition is not satisfied, the auxiliary controller (102) repeats the processing in the step ST11.

In the processing in the step ST12, the auxiliary controller (102) starts the auxiliary compressor (152). Once the auxiliary compressor (152) starts operating, the auxiliary refrigerant circuit (151) performs a refrigeration cycle and the refrigerant cooler (155) switches to a cooling mode.

After the start of the auxiliary compressor (152), the auxiliary controller (102) adjusts the rotational speed of the auxiliary compressor (152) so that the value Tpr measured by the refrigerant temperature sensor (157) reaches a second reference temperature Tr2. The auxiliary controller (102) adjusts the rotational speed of the auxiliary compressor (152) through the processing from steps ST13 to ST17.

In the processing in the step ST13, the auxiliary controller (102) determines whether the condition that the value Tpr measured by the refrigerant temperature sensor (157) is lower than the second reference temperature Tr2 (Tpr<Tr2) is satisfied. If this condition is satisfied, the auxiliary controller (102) performs the processing in the step ST14. In the processing in the step ST14, the auxiliary controller (102) reduces the operation frequency of the auxiliary compressor (152). With the reduction in the operation frequency of the auxiliary compressor (152), the flow rate of the secondary refrigerant in the auxiliary refrigerant circuit (151) decreases and the cooling capability of the refrigerant cooler (155) decreases.

After the end of the processing in the step ST14, the auxiliary controller (102) performs the processing in the step ST17. In the processing in the step ST17, the auxiliary controller (102) determines whether the auxiliary compressor (152) is stopped.

In the processing in the step ST14, once the operation frequency of the auxiliary compressor (152) is reduced and, as a result, reaches the lower limit, the auxiliary compressor (152) is stopped. Once the auxiliary compressor (152) is stopped, the auxiliary refrigerant circuit (151) stops the refrigeration cycle and the refrigerant cooler (155) switches to the inactive mode. Accordingly, once the auxiliary compressor (152) is stopped, the auxiliary controller (102) ends controlling the auxiliary compressor (152).

On the other hand, if the auxiliary compressor (152) is still operating even after reducing the operation frequency of the auxiliary compressor (152) in the processing in the step ST14, the auxiliary controller (102) performs the processing in the step ST13 again.

If the predetermined condition in the processing in the step ST13 is not satisfied, the auxiliary controller (102) performs the processing in the step ST15. In the processing in the step ST15, the auxiliary controller (102) determines whether the condition that the value Tpr measured by the refrigerant temperature sensor (157) is higher than the first reference temperature Tr1 (Tpr>Tr1) is satisfied. If this condition is satisfied, the auxiliary controller (102) performs the processing in the step ST16.

In the processing in the step ST16, the auxiliary controller (102) increases the operation frequency of the auxiliary compressor (152). With the increase in the operation frequency of the auxiliary compressor (152), the flow rate of the secondary refrigerant in the auxiliary refrigerant circuit (151) increases and the cooling capability of the refrigerant cooler (155) increases. After the end of the processing in the step ST16, the auxiliary controller (102) performs the processing in the step ST13 again.

If the predetermined condition in the processing in the step ST15 is not satisfied, the auxiliary controller (102) performs the processing in the step ST13 again. In this case, the value Tpr measured by the refrigerant temperature sensor (157) falls within the range from the second reference temperature Tr2 to the first reference temperature Tr1 (Tr2≤Tpr≤Tr1). In this case, the auxiliary controller (102) does not change the operation frequency of the auxiliary compressor (152).

In this manner, the auxiliary controller (102) controls the auxiliary compressor (152) to switch the refrigerant cooler (155) from the inactive mode to the cooling mode, based on the value Tpr measured by the refrigerant temperature sensor (157). On the other hand, the auxiliary controller (102) controls the auxiliary compressor (152) to switch the refrigerant cooler (155) from the cooling mode to the inactive mode, based on the value Tpr measured by the refrigerant temperature sensor (157).

The value Tpr measured by the refrigerant temperature sensor (157) represents the temperature of the primary refrigerant that has flowed out of the first channel (155*a*) into the refrigerant cooler (155) in the cooling operation. With a change in the temperature of the primary refrigerant, the specific enthalpy of the refrigerant supplied from the heat source unit (10) to the air-conditioning units (50) and the cooling units (60) changes. This results in a change in the cooling capabilities of the air-conditioning units (50) and the cooling units (60). That is, the value Tpr measured by the refrigerant temperature sensor (157) serves as an index indicating the refrigerating capacity of the heat source unit (10).

If the refrigerating capacity of the heat source unit (10) can be determined to be smaller than a predetermined value based on the index indicating the refrigerating capacity, the auxiliary controller (102) increases the cooling capability of the refrigerant cooler (155). On the other hand, of the refrigerating capacity of the heat source unit (10) can be determined to be larger than the predetermined value based on the index indicating the refrigerating capacity, the auxiliary controller (102) reduces the cooling capability of the refrigerant cooler (155).

<Second Reference Temperature>

The second reference temperature Tr2 is set to a temperature at which the refrigerant flowing through the outdoor expansion valve (14) into the receiver (15) is in the liquid single-phase state. Here, an operation of the controller (100) setting the second reference temperature will be described.

The outdoor controller (101) obtains a value measured by the liquid refrigerant pressure sensor (75). The value measured by the liquid refrigerant pressure sensor (75) is substantially equal to the pressure of the refrigerant in the receiver (15) and the pressure of the refrigerant flowing into the receiver (15). The outdoor controller (101) calculates the saturation temperature Ts of the primary refrigerant corresponding to the value measured by the liquid refrigerant pressure sensor (75).

The outdoor controller (101) also obtains a value measured by the high-pressure sensor (71). Based on the values measured by the liquid refrigerant pressure sensor (75) and the high-pressure sensor (71) as well as the calculated saturation temperature Ts, the outdoor controller (101) calculates the "temperature of the primary refrigerant flowing into the outdoor expansion valve (14)" such that the temperature of the primary refrigerant that has passed through the outdoor expansion valve (14) is lower than or equal to the saturation temperature Ts. The outdoor controller (101) then transmits, to the auxiliary controller (102), the calculated temperature as the second reference temperature Tr2. The outdoor controller (101) also transmits, to the auxiliary controller (102), the value (Tr2+D) obtained by adding a predetermined value to the second reference temperature Tr2, as the first reference temperature Tr1 (Tr1=Tr2+D).

—Operation of Indoor Controller—

In each air-conditioning unit (50) in the cooling operation, the indoor controller (103) adjusts the opening degree of the indoor expansion valve (53).

The indoor controller (103) adjusts the opening degree of the indoor expansion valve (53) so that the degree of superheat of the primary refrigerant, which has flowed out of the indoor heat exchanger (54) functioning as an evaporator, reaches a target degree of superheat.

Specifically, the indoor controller (103) sets a value obtained by subtracting a value T1 measured by the first temperature sensor (55) from a value T2 measured by the second temperature sensor (56) to be equal to an actually measured value SH representing the degree of superheat of the primary refrigerant that has flowed out of the indoor heat exchanger (54) (SH=T2−T1). If the actually measured value SH representing the degree of superheat exceeds the target degree of superheat, the indoor controller (103) increases the opening degree of the indoor expansion valve (53). If the measured value SH representing the degree of superheat is lower than the target degree of superheat, the indoor controller (103) reduces the opening degree of the indoor expansion valve (53).

Feature (1) of First Embodiment

The heat source unit (10) according to this embodiment includes the refrigerant cooler (155). Accordingly, the heat source unit (10) supplies the liquid refrigerant from the receiver (15) to the air-conditioning units (50) and the cooling units (60) at a higher flow rate than a heat source unit (10) without any refrigerant cooler (155). As a result, the refrigeration apparatus (1) including the heat source unit (10) according to this embodiment can exhibit a greater cooling capability than a refrigeration apparatus including a typical heat source unit without any refrigerant cooler (155). Now, this point will be described in detail with reference to FIG. 4.

In the typical heat source unit without any refrigerant cooler (155), the primary refrigerant, which has flowed out of the outdoor heat exchanger (13) functioning as a radiator (in the state at the point B in FIG. 4), is decompressed when passing through the outdoor expansion valve (14) and comes into the state indicated by the point X in FIG. 4. The primary refrigerant in the state at the point X corresponds to the gas-liquid two-phase state in which a liquid phase and a gas phase coexist.

In the typical heat source unit, the refrigerant in the state at the point X, which has passed through the outdoor expansion valve (14), flows into the receiver (15) and is separated into a saturated liquid refrigerant in the state at the point Y and a saturated gas refrigerant in the state at the point Z. The gas refrigerant in the state at the point Z is discharged from the receiver (15) to the venting pipe (37). That is, only the liquid refrigerant in the state at the point Y flows from the receiver (15) into the fourth outdoor pipe (o4). In this manner, in the typical heat source unit without any refrigerant cooler (155), the mass flow rate of the refrigerant sent from the receiver (15) to the air-conditioning units (50) or the cooling units (60) is lower than that of the refrigerant flowing into the receiver (15).

By contrast, in the heat source unit (10) according to this embodiment, the primary refrigerant that has flowed out of the outdoor heat exchanger (13) and then is cooled in the refrigerant cooler (155) passes through the outdoor expansion valve (14). Accordingly, the primary refrigerant in the liquid single-phase state, which has passed through the outdoor expansion valve (in the state at the point D in FIG. 4), flows into the receiver (15). That is, the mass flow rate of the primary refrigerant flowing from the receiver (15) into the fourth outdoor pipe (o4) is substantially equal to that of the primary refrigerant flowing from the second outdoor pipe (o2) into the receiver (15).

In this manner, in the heat source unit (10) according to this embodiment, the mass flow rate of the primary refrigerant sent from the receiver (15) to the air-conditioning units (50) or the cooling units (60) is substantially equal to that of the primary refrigerant flowing into the receiver (15). As a result, the flow rate of the refrigerant supplied to the air-conditioning units (50) and the cooling units (60) increases, and the cooling capabilities available in the air-conditioning units (50) and the cooling units (60) increase.

Feature (2) of First Embodiment

In the heat source unit (10) according to this embodiment, the controller (100) controls the auxiliary compressor (152) to switch the refrigerant cooler (155) between the cooling mode and the inactive mode. That is, this embodiment allows the switching of the refrigerant cooler (155) between the cooling mode and the inactive mode in accordance with the operating conditions of the heat source unit (10). As a result, the operation of the heat source unit (10) can be controlled properly in accordance with the operating conditions.

Feature (3) of First Embodiment

In the heat source unit (10) according to this embodiment, the secondary refrigerant circulating through the auxiliary refrigerant circuit (151) of the auxiliary unit (150) is used as the coolant for cooling the primary refrigerant in the refrigerant cooler (155). Accordingly, even in summer when the temperature of the outdoor air is relatively high, the temperature of the primary refrigerant flowing into the outdoor expansion valve (14) in the cooling operation of the refrigeration apparatus (1) can be lower than the temperature of the outdoor air.

As a result, even in summer when the temperature of the outdoor air is relatively high, the refrigerant can be supplied from the heat source unit (10) to the air-conditioning units (50) and the cooling units (60) at a sufficiently high flow rate. That is, the heat source unit (10) can exhibit a sufficient refrigerating capacity throughout the year.

Feature (4) of First Embodiment

In the heat source unit (10) according to this embodiment, the auxiliary controller (102) adjusts the rotational speed of the auxiliary compressor (152) based on the value measured by the refrigerant temperature sensor (157). This embodiment allows proper adjustment of the temperature of the primary refrigerant flowing out of the refrigerant cooler (155) in the cooling operation of the refrigeration apparatus (1).

First Variation of First Embodiment

In the heat source unit (10) according to this embodiment, the main unit (10*a*) and the auxiliary unit (150) may be integral. Specifically, the outdoor circuit (o1), the outdoor fan (12), the fan (17*a*), and the outdoor controller (101) forming the main unit (10*a*), and the auxiliary refrigerant circuit (151), the auxiliary fan (156), and the auxiliary controller (102) forming the auxiliary unit (150) may be housed in one casing.

In the heat source unit (10) according to this variation, the outdoor controller (101) and the auxiliary controller (102) may be integral. In other words, the heat source unit (10) according to this variation may include one controller (100) that performs both the control operation performed by the outdoor controller (101) and the control operation performed by the auxiliary controller (102).

Second Variation of First Embodiment

In the refrigeration apparatus (1) according to this embodiment, the primary refrigerant for filling the refrigerant circuit (6) and the secondary refrigerant for filling the auxiliary refrigerant circuit (151) are not necessarily carbon dioxide. In the refrigeration apparatus (1) according to this embodiment, the primary refrigerant and the secondary refrigerant may be different from each other.

Examples of the refrigerant with a single composition used as the primary refrigerant and the secondary refrigerant include R744 (carbon dioxide), R1234ZE, R1234YF, R290 (propane), and R32. Examples of the mixed refrigerant used as the primary refrigerant and the secondary refrigerant include a refrigerant containing at least one of R744, R1234ZE, R1234YF, R290, or R32 as an ingredient and having a global warming potential (GWP) of 750 or less.

The refrigerant used as the secondary refrigerant may have a higher critical temperature than the primary refrigerant. The carbon dioxide, which is used as the primary refrigerant in this embodiment, has a critical temperature of 31.1° C. If a refrigerant with a higher critical temperature than the primary refrigerant is used as the secondary refrigerant, a relatively large cooling capability is available from the refrigeration cycle of the auxiliary refrigerant circuit (151) even at a relatively high outdoor air temperature (e.g., 35° C. or higher). That is, the cooling capability of the refrigeration apparatus can be ensured.

The refrigerant used as the secondary refrigerant may have a higher critical temperature than the "upper limit of the operating temperature range of the refrigeration apparatus (1)." For example, if the upper limit of the operating temperature range of the refrigeration apparatus (1) is "43° C.," a refrigerant with a critical temperature (e.g., "53° C.") obtained by adding a predetermined value to "43° C." may be used as the secondary refrigerant.

Here, the "operating temperature range of the refrigeration apparatus (1)" corresponds to the range of the outdoor air temperature in which the refrigeration apparatus (1) can exhibit the "cooling capability of the refrigeration apparatus (1) as guaranteed by the manufacturer of the refrigeration apparatus (1) to the purchasers of the refrigeration apparatus (1)." Accordingly, even if the outdoor air temperature exceeds the upper limit of the "operating temperature range of the refrigeration apparatus (1)," the refrigeration apparatus (1) does not immediately become inoperable.

In the refrigeration apparatus (1) according to this embodiment, the main unit (10*a*) and the auxiliary unit (150) forming the heat source unit (10) are placed outdoors. Even if leaking from the auxiliary refrigerant circuit (151), the secondary refrigerant does not flow into the indoor space. Accordingly, if a "slightly flammable refrigerant" is used as the secondary refrigerant for filling the auxiliary refrigerant circuit (151) of the auxiliary unit (150), the slightly flammable secondary refrigerant does not flow into the indoor space even when leaking from the auxiliary refrigerant circuit.

Second Embodiment

A second embodiment will be described. Here, with respect to a refrigeration apparatus (1) according to this embodiment, differences from the refrigeration apparatus (1) according to the first embodiment will be described.

Figure 7:
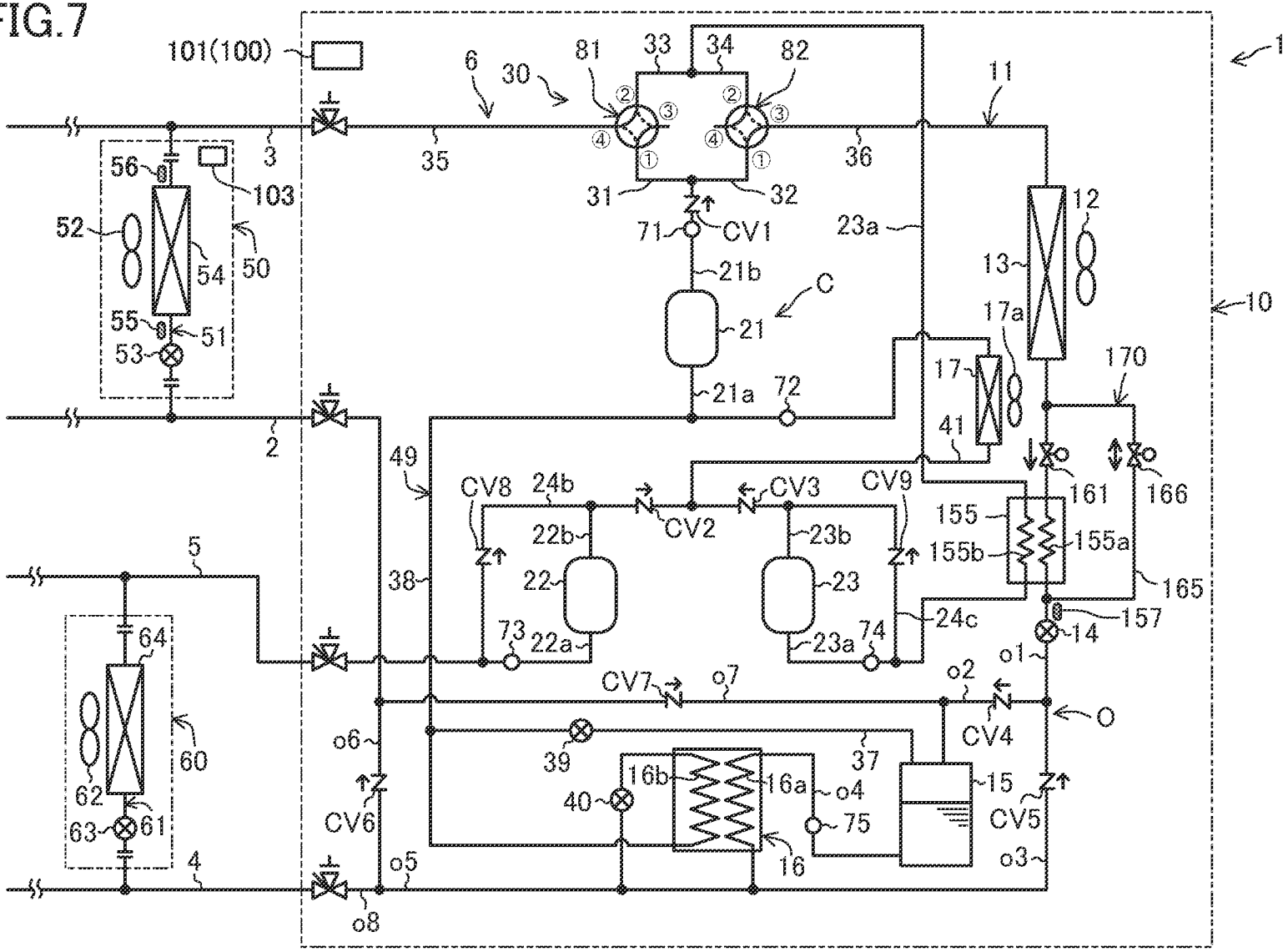
FIG. 7 is a piping system diagram showing a configuration of a refrigeration apparatus according to a second embodiment.

As illustrated in FIG. 7, the heat source unit (10) according to this embodiment excludes the auxiliary unit (150), includes the refrigerant cooler (155) at a different position, and further includes a bypass pipe (165). In addition, the indoor controller (103) of each air-conditioning unit (50) according to this embodiment performs the operation of adjusting a target degree of superheat.

In the heat source unit (10) according to this embodiment, one end of the first outdoor pipe (o1) is connected to the liquid end of the outdoor heat exchanger (13). The other end of the first outdoor pipe (o1) is connected to one end of the second outdoor pipe (o2) and one end of the third outdoor pipe (o3). In the first outdoor pipe (o1), the first channel (155*a*) of the refrigerant cooler (155) is interposed between the outdoor heat exchanger (13) and the outdoor expansion valve (14). In the first outdoor pipe (o1), an outdoor on-off valve (161) is interposed between the outdoor heat exchanger (13) and the refrigerant cooler (155). The outdoor on-off valve (161) is an electromagnetic valve.

In the heat source unit (10) according to this embodiment, the refrigerant temperature sensor (157) is placed in the first outdoor pipe (o1). The refrigerant temperature sensor (157) is placed at a portion of the first outdoor pipe (o1) between the refrigerant cooler (155) and the outdoor expansion valve (14), and measures the temperature of the refrigerant flowing through this portion. The value measured by the refrigerant temperature sensor (157) is transmitted to the outdoor controller (101).

In the heat source unit (10) according to this embodiment, the second channel (155*b*) of the refrigerant cooler (155) is provided in the first low-stage suction pipe (23*a*). In the refrigerant cooler (155) according to this embodiment, the refrigerant flowing through the first low-stage suction pipe (23*a*) toward the first low-stage compressor (23) flows, as a coolant, through the second channel (155*b*).

In the heat source unit (10) according to this embodiment, the bypass pipe (165) is connected to the first outdoor pipe (o1). One end of the bypass pipe (165) is connected to a point of the first outdoor pipe (o1) between the outdoor heat exchanger (13) and the outdoor on-off valve (161). The other end of the bypass pipe (165) is connected to a point of the first outdoor pipe (o1) between the refrigerant cooler (155) and the outdoor expansion valve (14). In the outdoor circuit (11), the bypass pipe (165) extends in parallel with the first channel (155*a*) of the refrigerant cooler (155).

The bypass pipe (165) includes a bypass valve (166). The bypass valve (166) is an on-off valve which is an electromagnetic valve. The bypass valve (166) enables and disables both the flows of the refrigerant from one end toward the other end of the bypass pipe (165) and from the other end toward the one end of the bypass pipe (165).

In the heat source unit (10) according to this embodiment, the bypass pipe (165), the bypass valve (166), and the outdoor on-off valve (161) form the switching section (170) that switches the refrigerant cooler (155) between the cooling mode and the inactive mode. When the bypass valve (166) is closed and the outdoor on-off valve (161) is open, the refrigerant flows through the first channel (155*a*) of the refrigerant cooler (155), and the refrigerant cooler (155) switches to the cooling mode. When the bypass valve (166) is open and the outdoor on-off valve (161) is closed, the refrigerant flows through the bypass pipe (165) and the refrigerant cooler (155) switches to the inactive mode.

Figure 8:
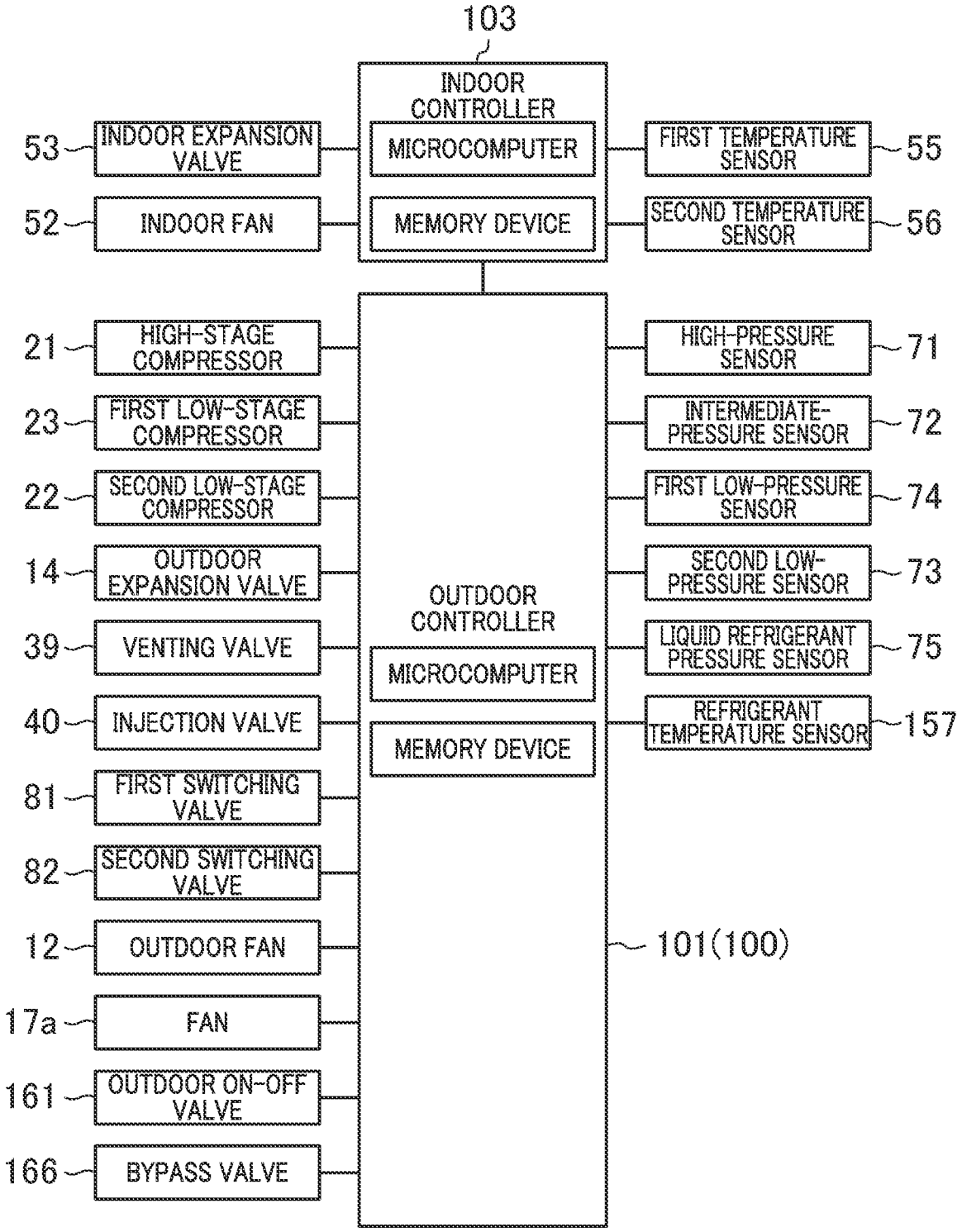
FIG. 8 is a block diagram showing a relationship among components, sensors, and a controller in the refrigeration apparatus according to the second embodiment.

As illustrated in FIG. 8, in the heat source unit (10) according to this embodiment, the outdoor controller (101) forms the controller (100) that controls the bypass valve (166) and the outdoor on-off valve (161) forming the switching section (170).

—Operation of Refrigeration Apparatus—An operation of the refrigeration apparatus (1) will be described. Like the refrigeration apparatus (1) according to the first embodiment, the refrigeration apparatus (1) according to this embodiment performs a cooling operation and a heating operation.

<Cooling Operation>

The cooling operation of the refrigeration apparatus (1) will be described. Here, with respect to the cooling operation of the refrigeration apparatus (1) according to this embodiment, differences from that of the refrigeration apparatus (1) according to the first embodiment will be described.

Here, the cooling operation where the refrigerant cooler (155) is in the cooling mode will be described. Once the controller (100) opens the outdoor on-off valve (161) and closes the bypass valve (166), the refrigerant cooler (155) switches to the cooling mode.

Figure 9:
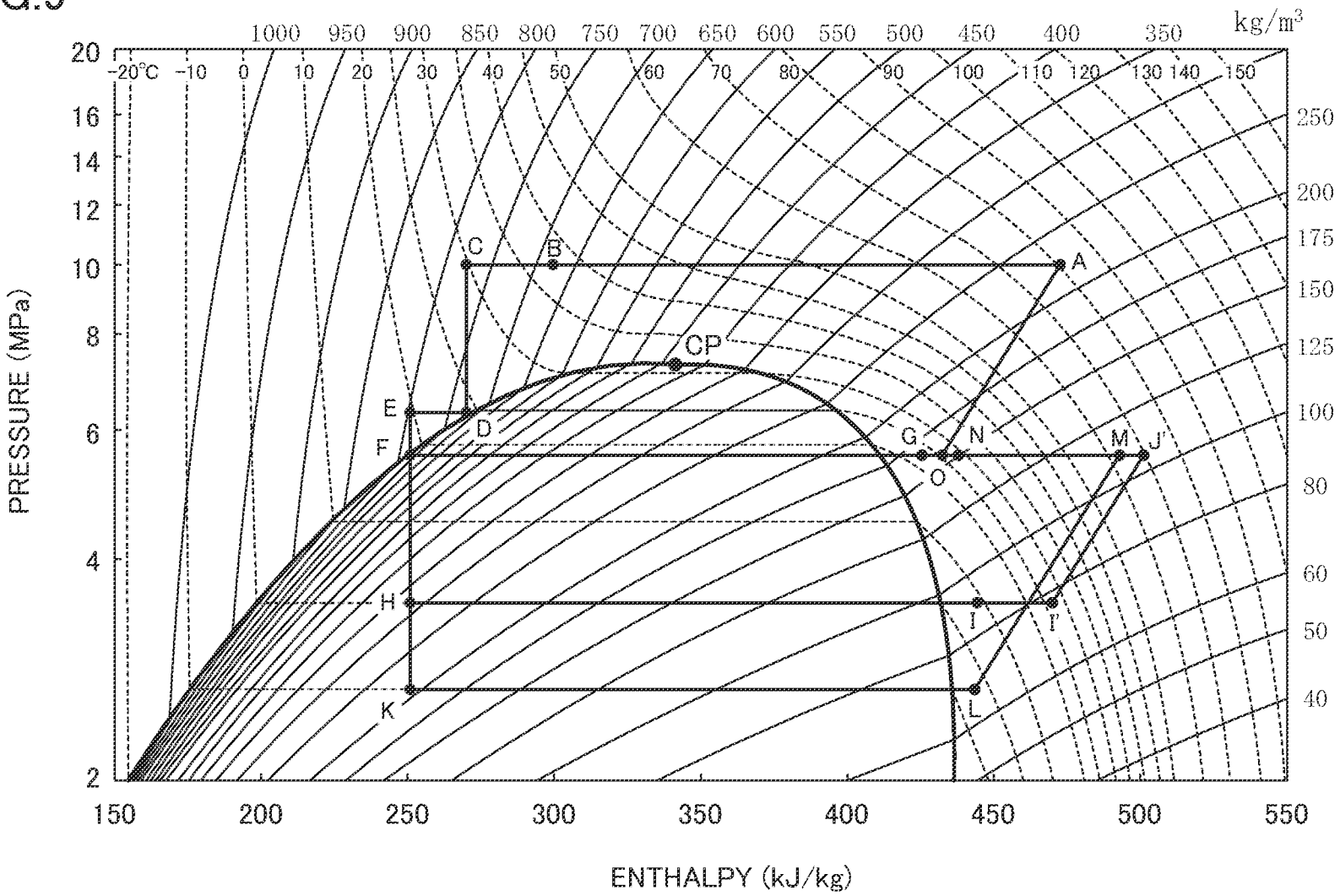
FIG. 9 is a Mollier diagram (pressure-enthalpy diagram) showing a refrigeration cycle in a refrigerant circuit in the cooling operation according to the second embodiment.

As illustrated in FIG. 9, in the heat source unit (10) according to this embodiment, the state of the refrigerant flowing from the first low-stage suction pipe (23*a*) of the outdoor circuit (11) to the intermediate channel (41) changes differently from that in the first embodiment. The Mollier diagram in FIG. 9 shows the refrigeration cycle performed in the refrigerant circuit (6) when the venting valve (39) is closed.

The refrigerant, which has flowed from the first outdoor gas pipe (35) through the first switching valve (81) into the first low-stage suction pipe (23*a*) (in the state at the point I in FIG. 9), flows into the second channel (155*b*) of the refrigerant cooler (155) and absorbs heat from the refrigerant flowing through the first channel (155*a*). The refrigerant that has flowed out of the second channel (155*b*) of the refrigerant cooler (155) (in the state at the point I' in FIG. 9) is sucked into and compressed by the first low-stage compressor (23). The refrigerant discharged from the first low-stage compressor (23) (in the state at the point J' in FIG. 9) flows into the intermediate channel (41) and merges into the refrigerant discharged from the second low-stage compressor (22) (in the state at the point M in FIG. 9).

<Heating Operation>

The heating operation of the refrigeration apparatus (1) will be described. Here, with respect to the heating operation of the refrigeration apparatus (1) according to this embodiment, differences from that of the refrigeration apparatus (1) according to the first embodiment will be described.

In the heating operation, the refrigerant cooler (155) is inactive. Once the controller (100) closes the outdoor on-off valve (161) and opens the bypass valve (166), the refrigerant cooler (155) switches to the inactive mode.

In the heating operation where the outdoor heat exchanger (13) functions as an evaporator, the heat source unit (10) according to this embodiment allows the refrigerant that has passed through the outdoor expansion valve (14) to flow through the bypass pipe (165) into the outdoor heat exchanger (13). The refrigerant flowing through the first low-stage suction pipe (23*a*) passes through the second channel (155*b*) of the refrigerant cooler (155) and is then sucked into the first low-stage compressor (23). Since the refrigerant cooler (155) is in the inactive mode, the refrigerant flowing through the second channel (155*b*) neither absorbs nor dissipates heat. The other refrigerant channels are the same as those in the heat source unit (10) according to the first embodiment.

—Operation of Controller—

The outdoor controller (101) according to this embodiment forming the controller (100) controls the bypass valve (166) and the outdoor on-off valve (161) forming the switching section (170), based on a value measured by the refrigerant temperature sensor (157).

Figure 10:
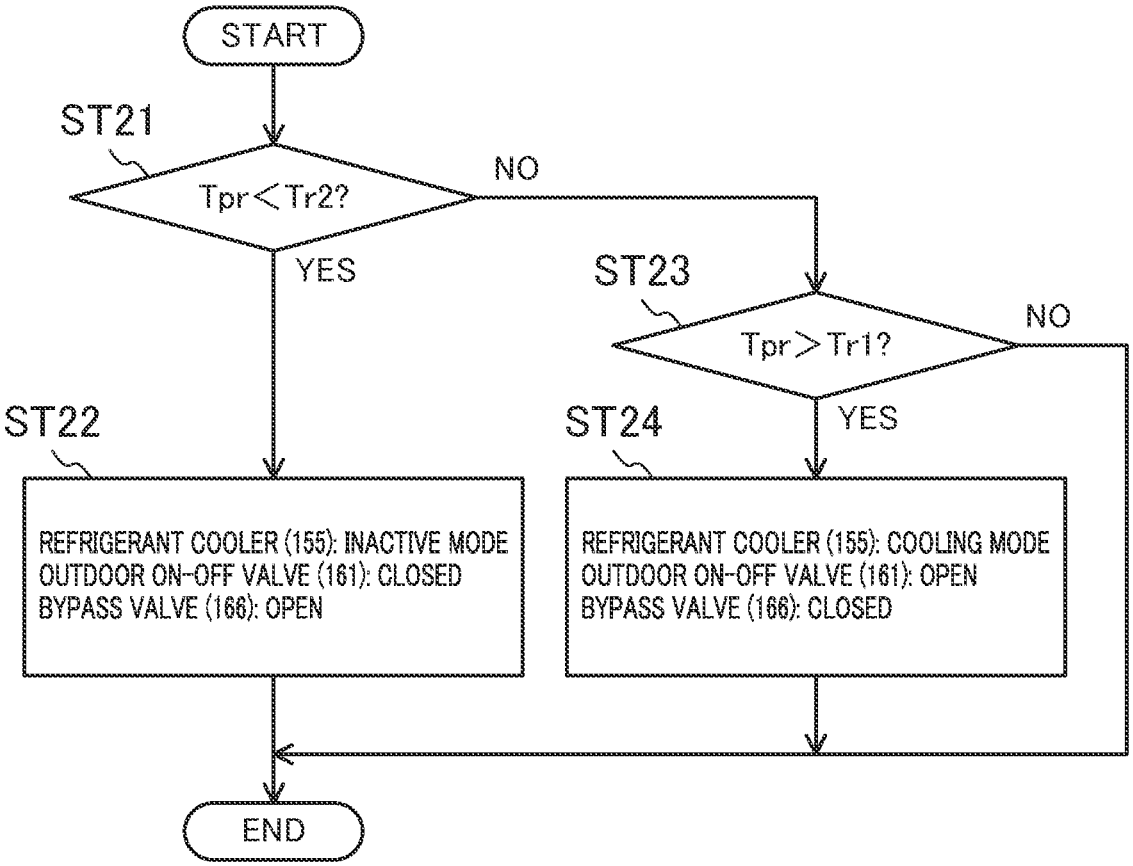
FIG. 10 is a flowchart showing an operation of an outdoor controller in the refrigeration apparatus according to the second embodiment.

The control operation of this outdoor controller (101) will be described with reference to the flowchart in FIG. 10. The outdoor controller (101) repeatedly executes the control operation shown in the flowchart in FIG. 10 at predetermined time intervals (e.g., every 60 seconds). The first reference temperature Tr1 and the second reference temperature Tr2 in the outdoor controller (101) according to this embodiment are the same as those in the first embodiment.

In the processing in a step ST21, the outdoor controller (101) determines whether the condition that the value Tpr measured by the refrigerant temperature sensor (157) is lower than the second reference temperature Tr2 (Tpr<Tr2) is satisfied. If this condition is satisfied, the outdoor controller (101) performs the processing in a step ST22. On the other hand, if this condition is not satisfied, the outdoor controller (101) performs the processing in a step ST23.

In the processing in the step ST22, the outdoor controller (101) closes the outdoor on-off valve (161) and opens the bypass valve (166). Once the outdoor controller (101) performs this processing, the refrigerant flows through the bypass pipe (165) and the refrigerant cooler (155) switches to the inactive mode. After the end of the processing in the step ST22, the outdoor controller (101) temporarily ends the control operations on the bypass valve (166) and the outdoor on-off valve (161).

In the processing in the step ST23, the outdoor controller (101) determines whether the condition that the value Tpr measured by the refrigerant temperature sensor (157) is higher than the first reference temperature Tr1 (Tpr>Tr1) is satisfied. If this condition is satisfied, the outdoor controller (101) performs the processing in a step ST24. On the other hand, if this condition is not satisfied, the outdoor controller (101) temporarily ends the control operations on the bypass valve (166) and the outdoor on-off valve (161).

In the processing in the step ST24, the outdoor controller (101) opens the outdoor on-off valve (161) and closes the bypass valve (166). Once the outdoor controller (101) performs this processing, the refrigerant flows through the first channel (155*a*) of the refrigerant cooler (155) and the refrigerant cooler (155) switches to the cooling mode. After the end of the processing in the step ST24, the outdoor controller (101) temporarily ends the control operations on the bypass valve (166) and the outdoor on-off valve (161).

—Operation of Indoor Controller—

An operation of the indoor controller (103) adjusting the target degree of superheat will be described.

The outdoor controller (101) according to this embodiment can output a cooling signal indicating that the refrigerant cooler (155) is in the cooling mode. The outdoor controller (101) outputs the cooling signal when the refrigerant cooler (155) is in the cooling mode and no cooling signal when the refrigerant cooler (155) is in the inactive mode.

The indoor controller (103) according to this embodiment can receive, from the outdoor controller (101), the cooling signal indicating that the refrigerant cooler (155) is in the cooling mode. While receiving no cooling signal, the indoor controller (103) sets the target degree of superheat to a first degree (e.g., 5° C.). While receiving the cooling signal, the indoor controller (103) sets the target degree of superheat to a second degree (e.g., 2° C.) that is lower than the first degree.

Once the indoor controller (103) reduces the target degree of superheat from the first degree to the second degree, the degree of superheat of the refrigerant flowing out of each air-conditioning unit (50) decreases. When the refrigerant cooler (155) is in the cooling mode, the degree of superheat of the refrigerant flowing through the first low-stage suction pipe (23*a*) into the second channel (155*b*) of the refrigerant cooler (155) decreases. This results in a decrease in the degree of superheat of the refrigerant flowing out of the second channel (155*b*) of the refrigerant cooler (155) and sucked into the first low-stage compressor (23).

Features of Second Embodiment

The refrigerant cooler (155) according to this embodiment cools the refrigerant flowing through the first channel (155*a*), using the refrigerant sucked into the first low-stage suction pipe (23*a*) as a coolant. Accordingly, the degree of superheat of the refrigerant sucked into the first low-stage suction pipe (23*a*) may be higher than that in a typical heat source unit without any refrigerant cooler (155).

On the other hand, when the refrigerant cooler (155) is in the cooling mode, the indoor controller (103) according to this embodiment reduces the target degree of superheat from the first degree to the second degree. Accordingly, the amount of the increase in the superheat of the refrigerant sucked into the first low-stage compressor (23) can be reduced. This can result in a reduction in an excessive increase in the degree of superheat of the refrigerant compressed in the first low-stage compressor (23) in advance and maintenance of the reliability of the first low-stage compressor (23).

Third Embodiment

A third embodiment will be described. Here, with respect to a refrigeration apparatus (1) according to this embodiment, differences from the refrigeration apparatus (1) according to the second embodiment will be described.

Figure 11:
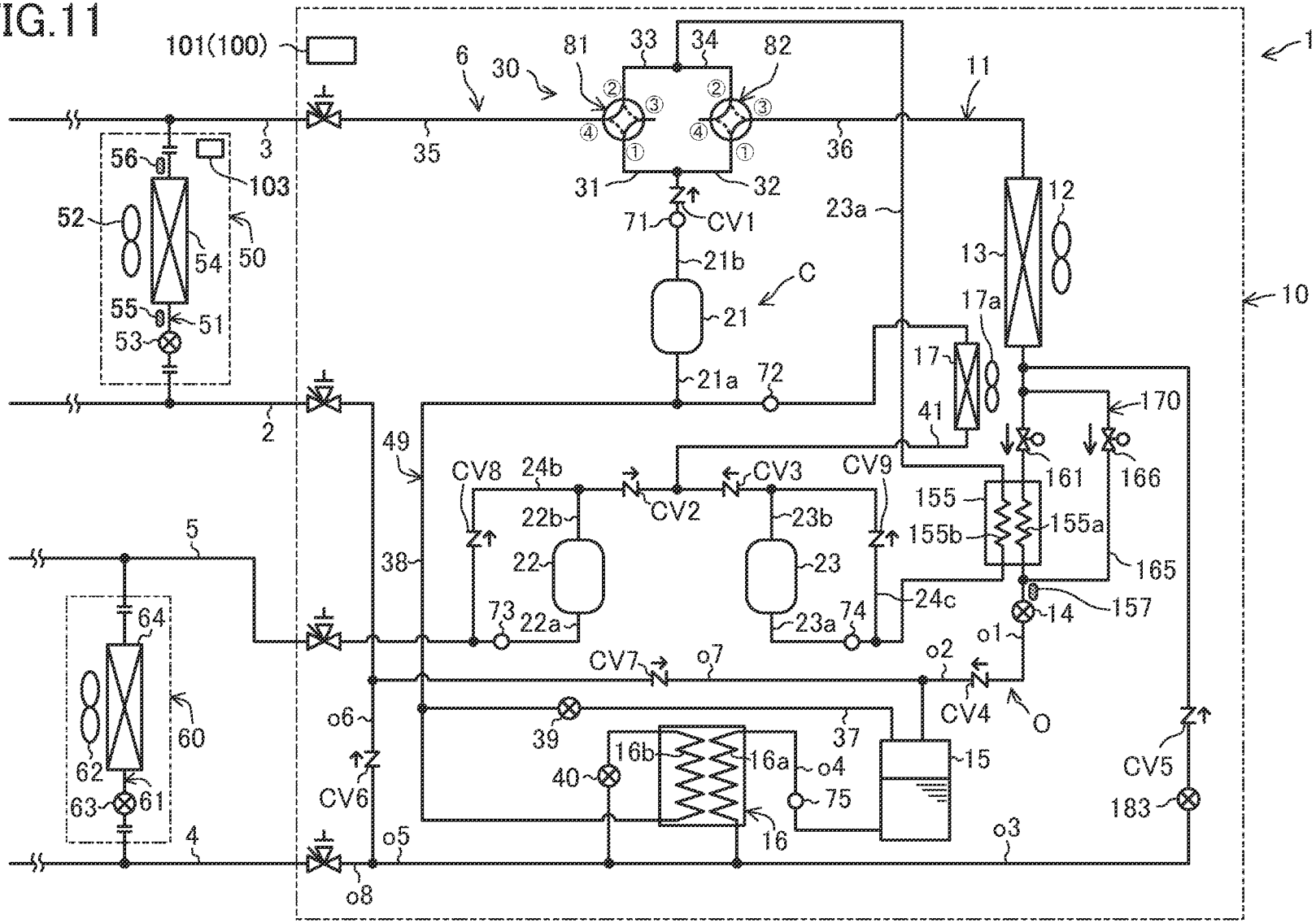
FIG. 11 is a piping system diagram showing a configuration of a refrigeration apparatus according to a third embodiment.

As illustrated in FIG. 11, in the heat source unit (10) according to this embodiment, the third outdoor pipe (o3) is connected at a point different from that in the outdoor circuit (11) according to the second embodiment. In the outdoor circuit (11) according to this embodiment, one end of the third outdoor pipe (o3) is connected to a point of the first outdoor pipe (o1) between the outdoor heat exchanger (13) and the outdoor on-off valve (161). Like in the second embodiment, the other end of the third outdoor pipe (o3) is connected to the other end of the fourth outdoor pipe (o4).

The third outdoor pipe (o3) according to this embodiment is provided with an auxiliary outdoor expansion valve (183). The auxiliary outdoor expansion valve (183) is interposed between the other end of the third outdoor pipe (o3) connected to the fourth outdoor pipe (o4) and the fifth check valve (CV5). The auxiliary outdoor expansion valve (183) is an electronic expansion valve having a variable opening degree.

The bypass valve (166) according to this embodiment enables and disables only the flow of the refrigerant from one end toward the other end of the bypass pipe (165).

—Operation of Refrigeration Apparatus—

An operation of the refrigeration apparatus (1) will be described. Like the refrigeration apparatus (1) according to the second embodiment, the refrigeration apparatus (1) according to this embodiment performs a cooling operation and a heating operation.

<Cooling Operation>

The cooling operation of the refrigeration apparatus (1) will be described. Here, with respect to the cooling operation of the refrigeration apparatus (1) according to this embodiment, differences from that of the refrigeration apparatus (1) according to the second embodiment will be described.

The heat source unit (10) according to this embodiment adjusts the opening degree of the outdoor expansion valve (14) and keeps closing the auxiliary outdoor expansion valve (183). Like in the second embodiment, the refrigerant, which has flowed out of the outdoor heat exchanger (13), flows through the first channel (155*a*) of the refrigerant cooler (155) or the bypass pipe (165) into the outdoor expansion valve (14) and is decompressed when passing through the outdoor expansion valve (14).

<Heating Operation>

The heating operation of the refrigeration apparatus (1) will be described. Here, with respect to the heating operation of the refrigeration apparatus (1) according to this embodiment, differences from that of the refrigeration apparatus (1) according to the second embodiment will be described.

In the heating operation in which the outdoor heat exchanger (13) functions as an evaporator, the heat source unit (10) according to this embodiment keeps closing the outdoor expansion valve (14) and adjusts the opening degree of the auxiliary outdoor expansion valve (183). The refrigerant that has flowed through the first channel (16*a*) of the subcooling heat exchanger (16) into the third outdoor pipe (o3) is decompressed when passing through the auxiliary outdoor expansion valve (183) and then flows into the outdoor heat exchanger (13).

Fourth Embodiment

A fourth embodiment will be described. Here, with respect to a refrigeration apparatus (1) according to this embodiment, differences from the refrigeration apparatus (1) according to the second embodiment will be described.

—Configuration of Refrigeration Apparatus—

Figure 12:
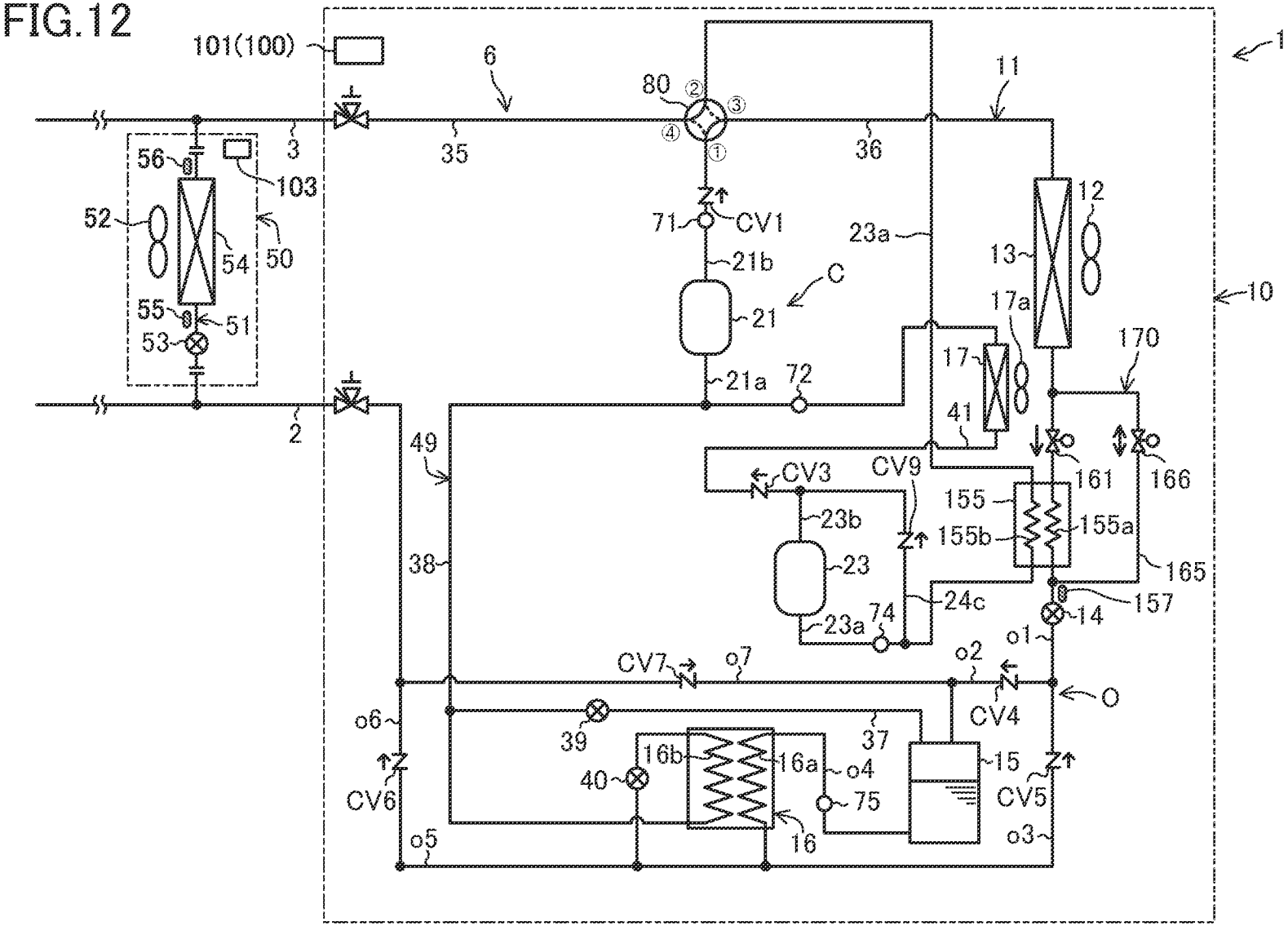
FIG. 12 is a piping system diagram showing a configuration of a refrigeration apparatus according to a fourth embodiment.

As illustrated in FIG. 12, the refrigeration apparatus (1) according to this embodiment excludes the cooling units (60) according to the second embodiment. In the refrigerant circuit (6) of the refrigeration apparatus (1) according to this embodiment, one heat source unit (10) and a plurality of air-conditioning units (50) are connected to each other by the first liquid connection pipe (2) and the second gas connection pipe (5).

The heat source unit (10) according to this embodiment excludes the second low-stage compressor (22), the second low-stage suction pipe (22*a*), and the second low-stage discharge pipe (22*b*) according to the second embodiment. The compression element (C) according to this embodiment includes the first low-stage compressor (23) and the high-stage compressor (21), but excludes the second low-stage compressor (22).

The heat source unit (10) according to this embodiment includes one switching valve (80) in place of the channel switching mechanism (30) according to the second embodiment. Like the first switching valve (81) and the second switching valve (82) according to the second embodiment, the switching valve (80) is a four-way switching valve. The switching valve (80) includes a first port connected to the high-stage discharge pipe (21*b*), a second port connected to the first low-stage suction pipe (23*a*), a third port connected to the second outdoor gas pipe (36), and a fourth port connected to the first outdoor gas pipe (35).

The switching valve (80) switches between a first state (the state indicated by the solid curves in FIG. 12) and a second state (the state indicated by the broken curves in FIG. 12). In the switching valve (80) in the first state, the first port and the third port communicate with each other, and the second port and the fourth port communicate with each other. In the switching valve (80) in the second state, the first port and the fourth port communicate with each other, and the second port and the third port communicate with each other. The switching valve (80) is set to the first state in the cooling operation of the refrigeration apparatus (1) and to the second state in the heating operation of the refrigeration apparatus (1).

Variation of Fourth Embodiment

The refrigeration apparatus (1) according to this embodiment may include a cooling unit, such as a refrigeration showcase or a unit cooler, in place of the air-conditioning units (50). In this case, in the refrigeration apparatus (1), the switching valve (80) switches from one to the other of the first state and the second state when switching between a cooling operation and a defrosting operation. The cooling operation is cooling the inside air in the cooling heat exchanger of the cooling unit. The defrosting operation is melting the frost attached to the cooling heat exchanger of the cooling unit.

Fifth Embodiment

A fifth embodiment will be described. Here, with respect to a refrigeration apparatus (1) according to this embodiment, differences from the refrigeration apparatus (1) according to the second embodiment will be described.

Figure 13:
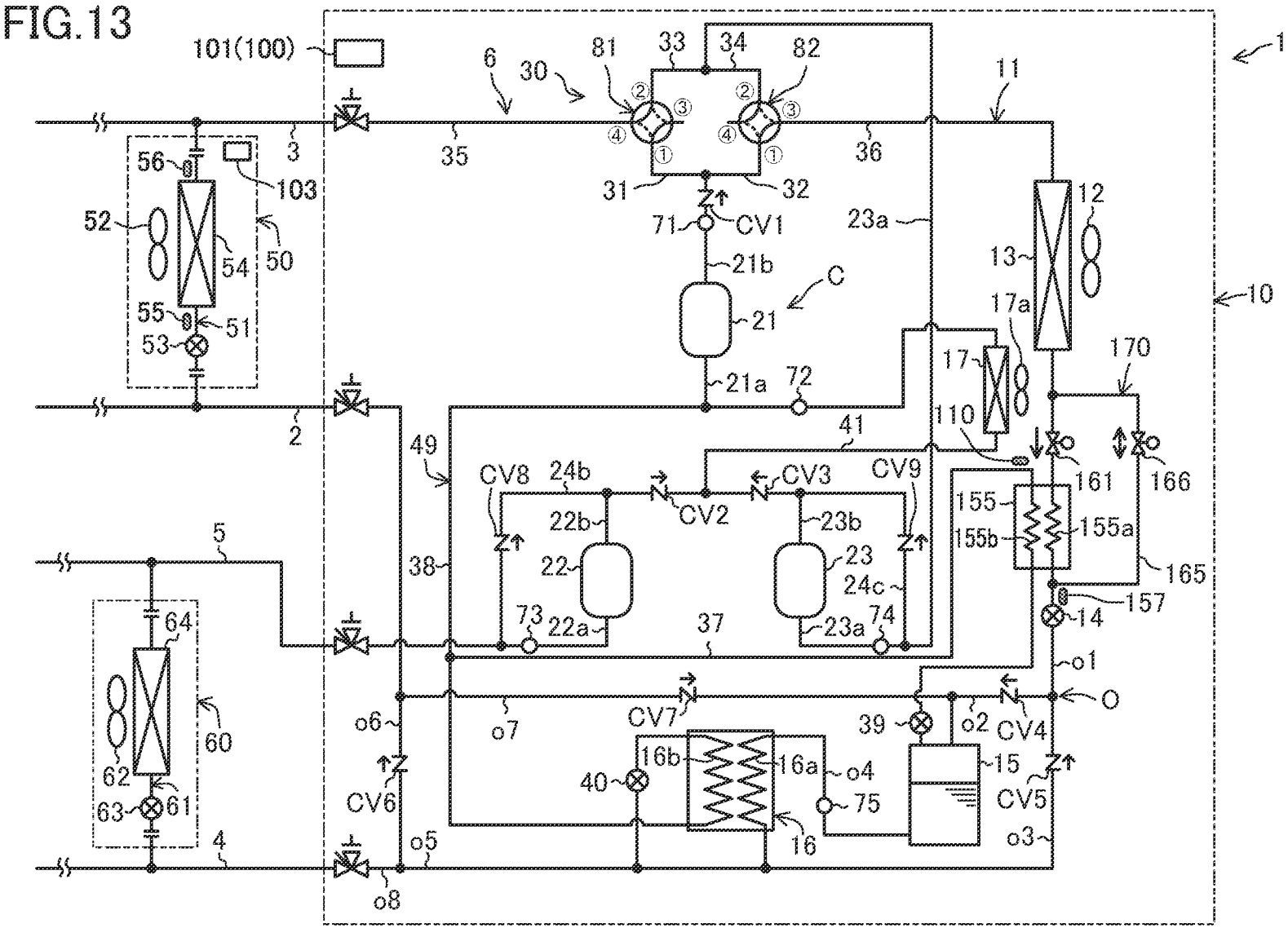
FIG. 13 is a piping system diagram showing a configuration of a refrigeration apparatus according to a fifth embodiment.

As illustrated in FIG. 13, in the heat source unit (10) according to this embodiment, the second channel (155*b*) of the refrigerant cooler (155) is provided in the venting pipe (37). In the venting pipe (37), the second channel (155*b*) of the refrigerant cooler (155) is placed downstream of the venting valve (39). In the refrigerant cooler (155) according to this embodiment, the primary refrigerant flowing from the receiver (15) through the venting pipe (37) toward the high-stage compressor (21) flows, as a coolant, through the second channel (155*b*).

The heat source unit (10) according to this embodiment includes a gas temperature sensor (110). The gas temperature sensor (110) is attached to the venting pipe (37). In the venting pipe (37), the gas temperature sensor (110) is placed downstream of the refrigerant cooler (155). The gas temperature sensor (110) measures the temperature of the refrigerant that has passed through the second channel (155*b*) of the refrigerant cooler (155). The value measured by the gas temperature sensor (110) is transmitted to the outdoor controller (101).

—Operation of Refrigeration Apparatus—

An operation of the refrigeration apparatus (1) will be described. Like the refrigeration apparatus (1) according to the second embodiment, the refrigeration apparatus (1) according to this embodiment performs a cooling operation and a heating operation.

<Cooling Operation>

The cooling operation of the refrigeration apparatus (1) will be described. Here, with respect to the cooling operation of the refrigeration apparatus (1) according to this embodiment, differences from that of the refrigeration apparatus (1) according to the second embodiment will be described.

Here, the cooling operation where the refrigerant cooler (155) is in the cooling mode will be described. Once the controller (100) opens the outdoor on-off valve (161) and closes the bypass valve (166), the refrigerant cooler (155) switches to the cooling mode.

The gas refrigerant that has flowed from the receiver (15) into the venting pipe (37) is decompressed when passing through the venting valve (39) and then flows into the second channel (155*b*) of the refrigerant cooler (155). In the refrigerant cooler (155), the refrigerant that has flowed into the second channel (155*b*) absorbs heat from the refrigerant flowing through the first channel (155*a*). As a result, in the refrigerant cooler (155), the refrigerant flowing through the first channel (155*a*) is cooled. The refrigerant that has passed through the second channel (155*b*) of the refrigerant cooler (155) is, together with the refrigerant flowing through the injection pipe (38), sucked into the high-stage compressor (21).

<Heating Operation>

The heating operation of the refrigeration apparatus (1) will be described. Here, with respect to the heating operation of the refrigeration apparatus (1) according to this embodiment, differences from that of the refrigeration apparatus (1) according to the second embodiment will be described. Like in the second embodiment, in the heating operation, the refrigerant cooler (155) is inactive. Once the controller (100) closes the outdoor on-off valve (161) and opens the bypass valve (166), the refrigerant cooler (155) switches to the inactive mode.

The gas refrigerant that has flowed from the receiver (15) into the venting pipe (37) passes through the venting valve (39) and the second channel (155*b*) of the refrigerant cooler (155) in this order, and is then sucked into the high-stage compressor (21). Since the refrigerant cooler (155) is in the inactive mode, the refrigerant flowing through the second channel (155*b*) neither absorbs nor dissipates heat. The other refrigerant channels are the same as those in the heat source unit (10) according to the second embodiment.

—Operation of Controller—

The outdoor controller (101), according to this embodiment, forming the controller (100) controls the bypass valve (166) and the outdoor on-off valve (161) forming the switching section (170), based on the values measured by the refrigerant temperature sensor (157) and the gas temperature sensor (110).

Figure 14:
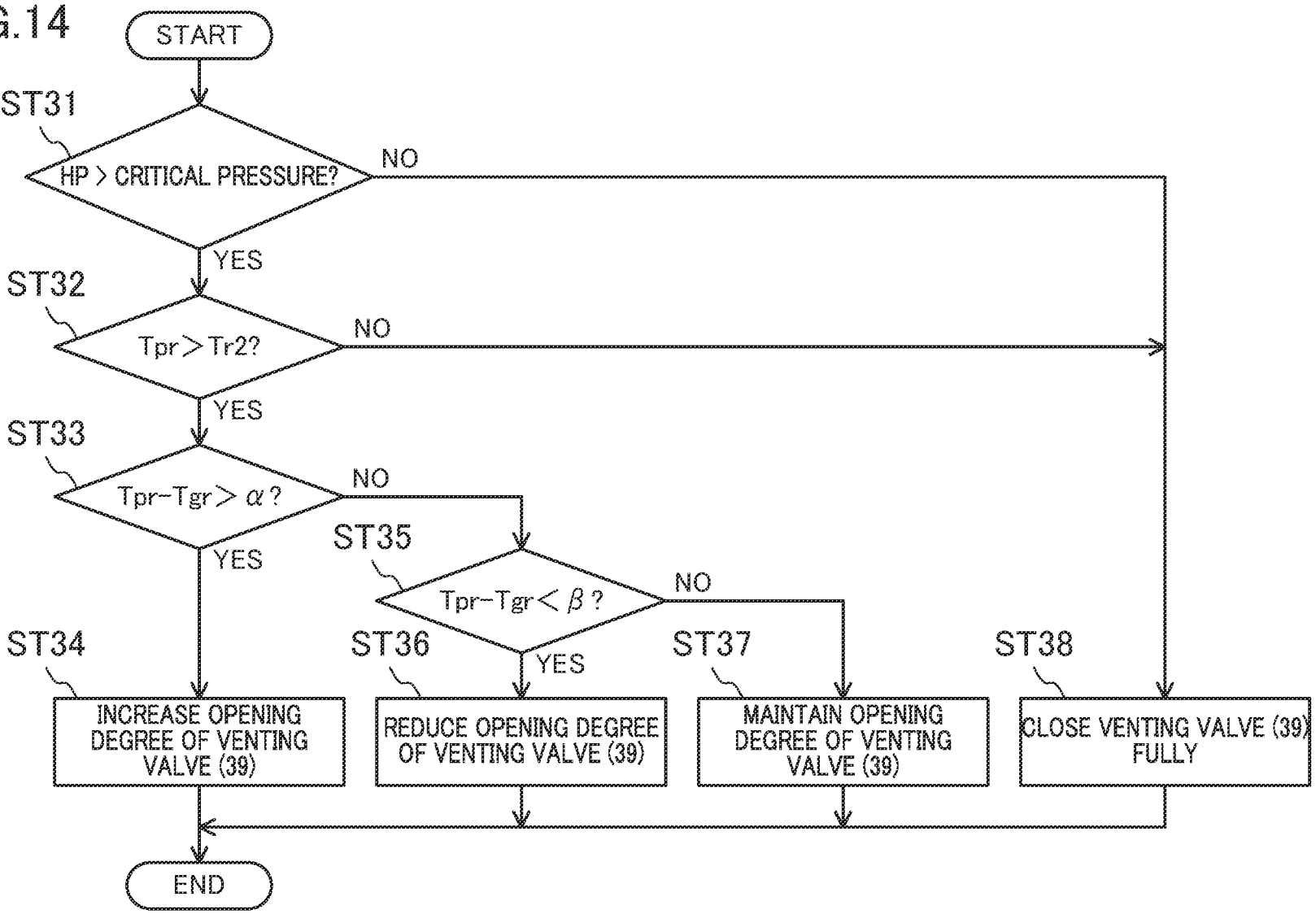
FIG. 14 is a flowchart showing an operation of an outdoor controller in the refrigeration apparatus according to the fifth embodiment.

The control operation of this outdoor controller (101) will be described with reference to the flowchart in FIG. 14. The outdoor controller (101) repeatedly executes the control operation shown in the flowchart in FIG. 14 at predetermined time intervals (e.g., every 60 seconds). The second reference temperature Tr2 in the outdoor controller (101) according to this embodiment is the same as that in the first embodiment.

In the processing in a step ST31, the outdoor controller (101) determines whether the condition that the value HP measured by the high-pressure sensor (71) is higher than a critical pressure CP of the primary refrigerant (carbon dioxide gas in this embodiment) (HP>CP) is satisfied. If this condition is satisfied, the outdoor controller (101) performs the processing in a step ST32. On the other hand, if this condition is not satisfied, the outdoor controller (101) performs the processing in a step ST38.

In the processing in the step ST32, the outdoor controller (101) determines whether the condition that the value Tpr measured by the refrigerant temperature sensor (157) is higher than the second reference temperature Tr2 (Tpr>Tr2) is satisfied. If this condition is satisfied, the outdoor controller (101) performs the processing in a step ST33. On the other hand, if this condition is not satisfied, the outdoor controller (101) performs the processing in the step ST38.

In the processing in the step ST33, the outdoor controller (101) determines whether the condition that the difference (Tpr−Tgr) between the value Tpr measured by the refrigerant temperature sensor (157) and the value Tgr measured by the gas temperature sensor (110) is larger than a predetermined value $\alpha$ (Tpr−Tgr>$\alpha$) is satisfied. If this condition is satisfied, the outdoor controller (101) performs the processing in a step ST34. On the other hand, if this condition is not satisfied, the outdoor controller (101) performs the processing in a step ST35. The predetermined value $\alpha$ is a constant recorded in advance in the outdoor controller (101) and is set to "5° C.," for example.

In the processing in the step ST34, the outdoor controller (101) increases the opening degree of the venting valve (39). If the condition (Tpr−Tgr>$\alpha$) in the step ST33 is satisfied, it can be determined that there is room to increase the cooling capability of the refrigerant cooler (155). Thus, if the condition in the step ST33 is satisfied, the outdoor controller (101) increases the opening degree of the venting valve (39) in the processing in the step ST34 to increase the flow rate of the refrigerant flowing through the second channel (155*b*) of the refrigerant cooler (155). After the end of the processing in the step ST34, the outdoor controller (101) temporarily ends the control of the opening degree of the venting valve (39).

In the processing in the step ST35, the outdoor controller (101) determines whether the condition that the difference (Tpr−Tgr) between the value Tpr measured by the refrigerant temperature sensor (157) and the value Tgr measured by the gas temperature sensor (110) is smaller than a predetermined value $\beta$ (Tpr−Tgr<$\beta$) is satisfied. If this condition is satisfied, the outdoor controller (101) performs the processing in a step ST36. On the other hand, if this condition is not satisfied, the outdoor controller (101) performs the processing in a step ST37. The predetermined value β is a constant recorded in advance in the outdoor controller (101) and is set to "3° C.," for example.

In the processing in the step ST36, the outdoor controller (101) reduces the opening degree of the venting valve (39). If the condition (Tpr−Tgr<β) in the step ST35 is satisfied, it can be determined that there is a need to reduce the cooling capability of the refrigerant cooler (155). Accordingly, if the condition in the step ST35 is satisfied, the outdoor controller (101) reduces the opening degree of the venting valve (39) in the processing in the step ST36 to reduce the flow rate of the refrigerant flowing through the second channel (155*b*) of the refrigerant cooler (155). After the end of the processing in the step ST36, the outdoor controller (101) temporarily ends the control of the opening degree of the venting valve (39).

In the processing in the step ST37, the outdoor controller (101) maintains the opening degree of the venting valve (39). If neither the condition (Tpr−Tgr>α) in the step ST33 nor the condition (Tpr−Tgr<1) in the step ST35 is satisfied, it can be determined that there is no need to change the cooling capability of the refrigerant cooler (155). Accordingly, in this case, the outdoor controller (101) does not change the opening degree of the venting valve (39). After the end of the processing in the step ST37, the outdoor controller (101) temporarily ends the control of the opening degree of the venting valve (39).

In the processing in the step ST38, the outdoor controller (101) fully closes the venting valve (39). When both the condition in the step ST31 (HP>CP) and the condition in the step ST32 (Tpr>Tr2) are not satisfied, it can be determined that there is no need to cool the refrigerant in the first channel (155*a*) in the refrigerant cooler (155). Accordingly, in this case, the outdoor controller (101) fully closes the venting valve (39). After the end of the processing in the step ST38, the outdoor controller (101) temporarily ends the control of the opening degree of the venting valve (39).

Features of Fifth Embodiment

In the refrigerant cooler (155) according to this embodiment, the refrigerant that flows from the outdoor heat exchanger (13) functioning as a radiator toward the outdoor expansion valve (14) flows through the first channel (155*a*). On the other hand, the refrigerant flowing out of the receiver (15) and decompressed by the venting valve (39) flows through the second channel (155*b*). In the refrigerant cooler (155), the refrigerant flowing through the first channel (155*a*) is cooled by the refrigerant flowing through the second channel (155*b*).

The temperature of the refrigerant flowing out of the outdoor heat exchanger (13) functioning as a radiator falls within a range, for example, from about 35° C. to about 40° C. On the other hand, the temperature of the gas refrigerant flowing from the receiver (15) into the venting pipe (37) is about 25° C., for example. Accordingly, in the refrigerant cooler (155) according to this embodiment, the difference between the temperatures of the refrigerants flowing through the first channel (155*a*) and through the second channel (155*b*) is relatively large. The refrigeration apparatus (1) according to this embodiment thus requires a smaller heat transfer area to ensure the amount of heat exchange in the refrigerant cooler (155) and can thus downsize the refrigerant cooler (155).

Other Embodiments

—First Variation—

In each of the heat source units (10) according to the first to fourth embodiments, the controller (100) may control the switching section (170) in accordance with the operating capacity of the compression element (C).

Upon the satisfaction of a first condition regarding the operating capacity of the compression element (C), the controller (100) according to this variation controls the switching section (170) to switch the refrigerant cooler (155) from the inactive mode to the cooling mode. The first condition is, for example, as follows: the rotational speed of the high-stage compressor (21) reaches a first reference speed (e.g., a maximum rotational speed); the rotational speed of the first low-stage compressor (23) reaches a second reference speed (e.g., a maximum rotational speed); and the rotational speed of the second low-stage compressor (22) reaches a third reference speed (e.g., a maximum rotational speed).

Upon the satisfaction of a second condition regarding the operating capacity of the compression element (C), the controller (100) according to this variation controls the switching section (170) to switch the refrigerant cooler (155) from the cooling mode to the inactive mode. The second condition is, for example, as follows: the rotational speed of the high-stage compressor (21) is lower than a fourth reference speed (a rotational speed lower than the maximum rotational speed); the rotational speed of the first low-stage compressor (23) is lower than a fifth reference speed (a rotational speed lower than the maximum rotational speed); and the rotational speed of the second low-stage compressor (22) is lower than a sixth reference speed (a rotational speed lower than the maximum rotational speed).

With a change in the rotational speed of the compressor (21, 22, 23) forming the compression element (C), the operating capacity of the compression element (C) also changes. With a change in the rotational speed of the compressor (21, 22, 23) forming the compression element (C), the mass flow rate of the refrigerant supplied from the heat source unit (10) to the air-conditioning units (50) and the cooling units (60) also changes. This results in a change in the cooling capabilities available in the air-conditioning units (50) and the cooling units (60). That is, the rotational speed of the compressor (21, 22, 23) in the heat source unit (10) serves as an index indicating the refrigerating capacity of the heat source unit (10).

Note that the index used by the controller (100) when controlling the switching section (170) to switch the refrigerant cooler (155) from the cooling mode to the inactive mode may be different from the index used by the controller (100) when controlling the switching section (170) to switch the refrigerant cooler (155) from the inactive mode to the cooling mode. For example, the controller (100) may control the switching section (170) to switch the refrigerant cooler (155) from the cooling mode to the inactive mode, based on the rotational speed of the compressor (21, 22, 23) in the heat source unit (10). On the other hand, the controller (100) may control the switching section (170) to switch the refrigerant cooler (155) from the inactive mode to the cooling mode, based on the value measured by the refrigerant temperature sensor (157).

—Second Variation—

Each of the heat source units (10) according to the first to fourth embodiments may exclude the venting pipe (37) and the venting valve (39). For example, to adjust the cooling capability of the refrigerant cooler (155) so that the refrigerant flowing into the receiver (15) is always in a liquid single-phase state in the cooling operation of the refrigeration apparatus (1), there is no need for the outdoor circuit (11) to include the venting pipe (37) or the venting valve (39).

—Third Variation—

Each of the heat source units (10) according to the first to fourth embodiments may use, for example, cooling water cooled by a cooling tower, as a coolant for cooling the refrigerant in the refrigerant cooler (155). The coolant may be a fluid with a temperature (e.g., 30° C. or lower) lower than the temperature of outdoor air in summer.

—Fourth Variation—

Each of the heat source units (10) according to the first to fourth embodiments may perform a multi-stage compression refrigeration cycle including three or more stages. In this case, in the heat source unit (10), the compressor at the lowest stage serves as a low-stage compressor (23), and the compressor at the highest stage serves as a high-stage compressor (21).

Each of the heat source units (10) according to the first to fourth embodiments may perform a single-stage compression refrigeration cycle.

—Fifth Variation—

In each of the auxiliary controller (102) according to the first embodiment and the outdoor controllers (101) according to the second to fifth embodiments, the second reference temperature Tr2 is set in accordance with the operating state of the refrigeration apparatus (1). Alternatively, the second reference temperature Tr2 may be a certain value set in advance.

A primary refrigerant made of carbon dioxide has a second reference temperature Tr2 of "32° C.," for example. If the second reference temperature Tr2 is a certain value, the first reference temperature Tr1 is also a certain value. If the second reference temperature Tr2 is 32° C., the first reference temperature Tr1 is set to "35° C.," for example. Note that the values of the first reference temperature Tr1 and the second reference temperature Tr2 shown here are mere examples. For example, the second reference temperature Tr2 may be set to "29° C.," while the first reference temperature Tr1 may be set to "37° C."

In the heat source unit (10) according to this variation, if the temperature of the primary refrigerant, which has passed through the outdoor expansion valve (14) in the cooling operation of the refrigeration apparatus (1), is lower than or equal to the saturation temperature Ts, the refrigerant flowing into the receiver (15) is in a liquid single-phase state. On the other hand, if the temperature of the primary refrigerant, which has passed through the outdoor expansion valve (14), is higher than the saturation temperature Ts in the cooling operation of the refrigeration apparatus (1), the refrigerant flowing into the receiver (15) is in a gas-liquid two-phase state. As described above, the saturation temperature Ts is the saturation temperature of the primary refrigerant corresponding to the value measured by the liquid refrigerant pressure sensor (75).

—Sixth Variation— in each of the refrigeration apparatuses (1) according to the second to fifth embodiments, the refrigerant (primary refrigerant) for filling the refrigerant circuit (6) is not necessarily carbon dioxide. The refrigerant applicable to each of the refrigerant circuits (6) according to the second to fifth embodiments is the same as that applicable as the primary refrigerant in the refrigeration apparatus (1) according to the first embodiment.

While the embodiments and variations thereof have been described above, it will be understood that various changes in form and details may be made without departing from the spirit and scope of the claims. The foregoing embodiments and variations thereof may be combined and replaced with each other without deteriorating the intended functions of the present disclosure. In addition, the expressions of "first," "second," and "third" in the specification and claims are used to distinguish the terms to which these expressions are given, and do not limit the number and order of the terms.

Industrialapplicability

As can be seen in the foregoing, the present disclosure is useful for a heat source unit and a refrigeration apparatus.

DESCRIPTION OF REFERENCE CHARACTERS

1 Refrigeration Apparatus
10 Heat Source Unit
13 Outdoor Heat Exchanger (First Heat Exchanger)
14 Outdoor Expansion Valve (First Expansion Valve)
15 Receiver
16 Subcooling Heat Exchanger (First Cooler)
21 High-Stage Compressor
22 Second Low-Stage Compressor (Compressor)
23 First Low-Stage Compressor (Compressor, Low-Stage Compressor)
37 Venting Pipe (Gas Pipe)
39 Venting Valve (Decompression Section)
50 Air-Conditioning Unit (Utilization Unit)
53 Indoor Expansion Valve (Second Expansion Valve)
54 Indoor Heat Exchanger (Second Heat Exchanger)
60 Cooling Unit (Utilization Unit)
100 Controller
101 Outdoor Controller
102 Auxiliary Controller
103 Indoor Controller (Superheat Controller)
151 Auxiliary Refrigerant Circuit
152 Auxiliary Compressor
155 Refrigerant Cooler (Second Cooler)
165 Bypass Pipe
166 Bypass Valve
170 Switching Section

The invention claimed is:

1. A heat source unit connected to a utilization unit and configured to perform a refrigeration cycle by circulating a primary refrigerant between the heat source unit and the utilization unit, a maximum pressure of the primary refrigerant in the refrigeration cycle being higher than or equal to a critical pressure of the primary refrigerant, the heat source unit comprising:

a compressor configured to suck and compress the primary refrigerant;

a first heat exchanger configured to exchange heat between the primary refrigerant and outdoor air;

a first expansion valve configured to decompress the primary refrigerant that has flowed out of the first heat exchanger functioning as a radiator;

a receiver configured to receive the primary refrigerant that has flowed out of the first heat exchanger functioning as a radiator and passed through the first expansion valve;

a first cooler configured to cool the primary refrigerant flowing from the receiver toward the utilization unit;

a second cooler configured to cool the primary refrigerant flowing from the first heat exchanger functioning as a radiator toward the first expansion valve, using a coolant other than the outdoor air; and a controller configured to control cooling capability of the second cooler so that a gas refrigerant contained in the primary refrigerant flowing into the receiver after passing through the first expansion valve decreases compared to a case in which the second cooler does not cool the primary refrigerant.

2. The heat source unit of claim 1, wherein the controller is further configured to switch the second cooler between a cooling mode of cooling the primary refrigerant and an inactive mode of cooling no primary refrigerant.

3. The heat source unit of claim 2, wherein the controller is further configured to switch the second cooler from the inactive mode to the cooling mode, based on an index indicating a refrigerating capacity of the heat source unit.

4. The heat source unit of claim 2, wherein the controller is further configured to switch the second cooler from the inactive mode to the cooling mode, based on a temperature of the primary refrigerant that has flowed out of the first heat exchanger functioning as a radiator and passed through the second cooler.

5. The heat source unit of claim 1, further comprising:

an auxiliary refrigerant circuit connected to the second cooler, including an auxiliary compressor, and configured to perform a refrigeration cycle by compressing a secondary refrigerant as the coolant in the auxiliary compressor.

6. The heat source unit of claim 5, wherein the controller includes an auxiliary controller configured to adjust a rotational speed of the auxiliary compressor, based on a temperature of the primary refrigerant cooled in the second cooler.

7. The heat source unit of claim 2, further comprising:

an auxiliary refrigerant circuit connected to the second cooler, including an auxiliary compressor, and configured to perform a refrigeration cycle by compressing a secondary refrigerant as the coolant in the auxiliary compressor, wherein the controller switches the second cooler to the cooling mode by operating the auxiliary compressor and switches the second cooler to the inactive mode by stopping the auxiliary compressor.

8. The heat source unit of claim 1, wherein the coolant supplied to the second cooler is the primary refrigerant sucked into the compressor.

9. The heat source unit of claim 2, wherein the coolant supplied to the second cooler is the primary refrigerant sucked into the compressor.

10. The heat source unit of claim 1, wherein the compressor includes a low-stage compressor configured to suck and compress the primary refrigerant, and a high-stage compressor configured to suck and compress the primary refrigerant discharged from the low-stage compressor, and the coolant supplied to the second cooler is the primary refrigerant sucked into the low-stage compressor.

11. The heat source unit of claim 2, wherein the compressor includes a low-stage compressor configured to suck and compress the primary refrigerant, and a high-stage compressor configured to suck and compress the primary refrigerant discharged from the low-stage compressor, and the coolant supplied to the second cooler is the primary refrigerant sucked into the low-stage compressor.

12. The heat source unit of claim 1, wherein the compressor includes a low-stage compressor configured to suck and compress the primary refrigerant, and a high-stage compressor configured to suck and compress the primary refrigerant discharged from the low-stage compressor, the heat source unit further comprising:

a gas pipe connected to the receiver and the high-stage compressor and configured to send a gas refrigerant of the receiver to the high-stage compressor; and a decompression section placed in the gas pipe and configured to decompress the gas refrigerant flowing through the gas pipe, and the coolant supplied to the second cooler is a primary refrigerant that has passed through the decompression section in the gas pipe.

13. The heat source unit of claim 2, wherein the compressor includes a low-stage compressor configured to suck and compress the primary refrigerant, and a high-stage compressor configured to suck and compress the primary refrigerant discharged from the low-stage compressor, the heat source unit further comprising:

a gas pipe connected to the receiver and the high-stage compressor and configured to send a gas refrigerant of the receiver to the high-stage compressor; and a decompression section placed in the gas pipe and configured to decompress the gas refrigerant flowing through the gas pipe, and the coolant supplied to the second cooler is a primary refrigerant that has passed through the decompression section in the gas pipe.

14. The heat source unit of claim 9, further comprising:

a bypass pipe which is placed in parallel with the second cooler and through which the primary refrigerant flows from the first heat exchanger functioning as a radiator toward the first expansion valve; and a bypass valve provided in the bypass pipe.

15. The heat source unit of claim 11, further comprising:

a bypass pipe which is placed in parallel with the second cooler and through which the primary refrigerant flows from the first heat exchanger functioning as a radiator toward the first expansion valve; and a bypass valve provided in the bypass pipe.

16. The heat source unit of claim 13, further comprising:

a bypass pipe which is placed in parallel with the second cooler and through which the primary refrigerant flows from the first heat exchanger functioning as a radiator toward the first expansion valve; and a bypass valve provided in the bypass pipe.

17. A refrigeration apparatus comprising:

the heat source unit of claim 1; and the utilization unit connected to the heat source unit.

18. A refrigeration apparatus comprising:

the heat source unit of claim 9;

a utilization unit including a second heat exchanger and a second expansion valve and connected to the heat source unit; and a superheat controller configured to adjust an opening degree of the second expansion valve to set a degree of superheat of the primary refrigerant at an outlet of the second heat exchanger to a target degree of superheat in an operation of the second heat exchanger functioning as an evaporator, the superheat controller being configured to set the target degree of superheat lower when the second cooler is in the cooling mode than when the second cooler is in the inactive mode.

19. A refrigeration apparatus comprising:

the heat source unit of claim 11;

a utilization unit including a second heat exchanger and a second expansion valve and connected to the heat source unit; and a superheat controller configured to adjust an opening degree of the second expansion valve to set a degree of superheat of the primary refrigerant at an outlet of the second heat exchanger to a target degree of superheat in an operation of the second heat exchanger functioning as an evaporator, the superheat controller being configured to set the target degree of superheat lower when the second cooler is in the cooling mode than when the second cooler is in the inactive mode.

20. A refrigeration apparatus comprising:

the heat source unit of claim 13;

a utilization unit including a second heat exchanger and a second expansion valve and connected to the heat source unit; and a superheat controller configured to adjust an opening degree of the second expansion valve to set a degree of superheat of the primary refrigerant at an outlet of the second heat exchanger to a target degree of superheat in an operation of the second heat exchanger functioning as an evaporator, the superheat controller being configured to set the target degree of superheat lower when the second cooler is in the cooling mode than when the second cooler is in the inactive mode.

21. A heat source unit connected to a utilization unit and configured to perform a refrigeration cycle by circulating a primary refrigerant between the heat source unit and the utilization unit, a maximum pressure of the primary refrigerant in the refrigeration cycle being higher than or equal to a critical pressure of the primary refrigerant, the heat source unit comprising:

a compressor configured to suck and compress the primary refrigerant;

a first heat exchanger configured to exchange heat between the primary refrigerant and outdoor air;

a first expansion valve configured to decompress the primary refrigerant that has flowed out of the first heat exchanger functioning as a radiator;

a receiver configured to receive the primary refrigerant that has flowed out of the first heat exchanger functioning as a radiator and passed through the first expansion valve;

a first cooler configured to cool the primary refrigerant flowing from the receiver toward the utilization unit;

a second cooler configured to cool the primary refrigerant flowing from the first heat exchanger functioning as a radiator toward the first expansion valve, using a coolant other than the outdoor air; and a controller configured to switch the second cooler between a cooling mode of cooling the primary refrigerant and an inactive mode of cooling no primary refrigerant, the controller being configured to switch the second cooler from the inactive mode to the cooling mode when a temperature of the primary refrigerant that has flowed out of the first heat exchanger functioning as a radiator and passed through the second cooler is higher than a predetermined temperature.

22. A heat source unit connected to a utilization unit and configured to perform a refrigeration cycle by circulating a primary refrigerant between the heat source unit and the utilization unit, a maximum pressure of the primary refrigerant in the refrigeration cycle being higher than or equal to a critical pressure of the primary refrigerant, the heat source unit comprising:

a compressor configured to suck and compress the primary refrigerant;

a first heat exchanger configured to exchange heat between the primary refrigerant and outdoor air;

a first expansion valve configured to decompress the primary refrigerant that has flowed out of the first heat exchanger functioning as a radiator;

a receiver configured to receive the primary refrigerant that has flowed out of the first heat exchanger functioning as a radiator and passed through the first expansion valve;

a first cooler configured to cool the primary refrigerant flowing from the receiver toward the utilization unit;

a second cooler configured to cool the primary refrigerant flowing from the first heat exchanger functioning as a radiator toward the first expansion valve, using a coolant other than the outdoor air;

an auxiliary refrigerant circuit connected to the second cooler, including an auxiliary compressor, and configured to perform a refrigeration cycle by compressing a secondary refrigerant as the coolant in the auxiliary compressor;

a main unit that houses the compressor, the first heat exchanger, the first expansion valve, the receiver, and the first cooler;

an auxiliary unit that houses the second cooler and the auxiliary refrigerant circuit; and a first connection pipe and a second connection pipe that connect the main unit and the auxiliary unit to each other and carry the primary refrigerant.

* * * * *